US009321285B2

(12) United States Patent
Hirashima et al.

(10) Patent No.: US 9,321,285 B2
(45) Date of Patent: Apr. 26, 2016

(54) PRINTER

(71) Applicant: Seiko Epson Corporation, Tokyo (JP)

(72) Inventors: Taku Hirashima, Matsumoto (JP); Hironori Maekawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/538,385

(22) Filed: Nov. 11, 2014

(65) Prior Publication Data

US 2015/0197105 A1 Jul. 16, 2015

(30) Foreign Application Priority Data

Nov. 12, 2013 (JP) ..... 2013-233738
Dec. 25, 2013 (JP) ..... 2013-266622

(51) Int. Cl.
*B41J 11/04* (2006.01)
*B41J 11/00* (2006.01)
*B41J 13/14* (2006.01)

(52) U.S. Cl.
CPC ..... *B41J 11/04* (2013.01); *B41J 11/0005* (2013.01); *B41J 11/005* (2013.01); *B41J 13/14* (2013.01)

(58) Field of Classification Search
CPC ..... B41J 2/01; B41J 11/04
USPC ..... 347/104
See application file for complete search history.

(56) References Cited

U.S. PATENT DOCUMENTS

| | | | | |
|---|---|---|---|---|
| 5,291,224 | A * | 3/1994 | Asano et al. | 346/134 |
| 6,629,787 | B2 * | 10/2003 | Lee et al. | 400/59 |
| 7,735,991 | B2 * | 6/2010 | Asano | 347/102 |
| 2005/0206708 | A1 | 9/2005 | Yoda | |
| 2008/0030563 | A1 * | 2/2008 | Yoshida | 347/104 |
| 2009/0244240 | A1 | 10/2009 | Sugahara | |

FOREIGN PATENT DOCUMENTS

| | | | |
|---|---|---|---|
| JP | 2008-062432 | A | 3/2008 |
| JP | 04-164766 | A | 10/2008 |
| JP | 04274180 | B2 | 6/2009 |
| JP | 2009-203020 | A | 9/2009 |
| JP | 2009-262544 | A | 11/2009 |
| WO | 2013/154538 | A1 | 10/2013 |

* cited by examiner

*Primary Examiner* — Justin Seo
*Assistant Examiner* — Michael Konczal
(74) *Attorney, Agent, or Firm* — Nutter McClennen & Fish LLP; John J. Penny, Jr.; Joshua I. Rudawitz

(57) ABSTRACT

A printer has a platen top unit fastened above the platen unit. The platen top unit is separate from the platen unit, and has first star wheels and second star wheels disposed on parallel horizontal frame members extending perpendicularly to the media conveyance direction above the platen surface. The first star wheels and second star wheels prevent the continuous paper conveyed over the platen surface from lifting away from the platen surface.

15 Claims, 18 Drawing Sheets

FIG. 6C
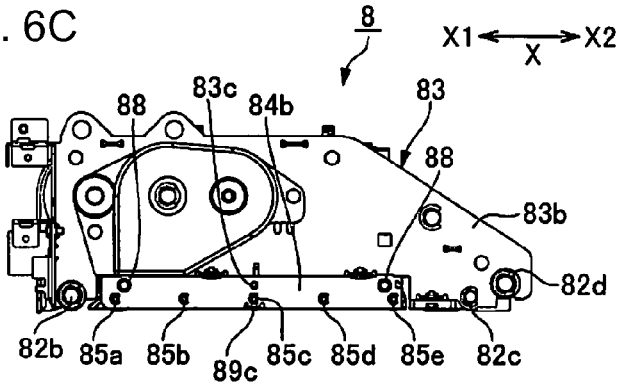
FIG. 6D
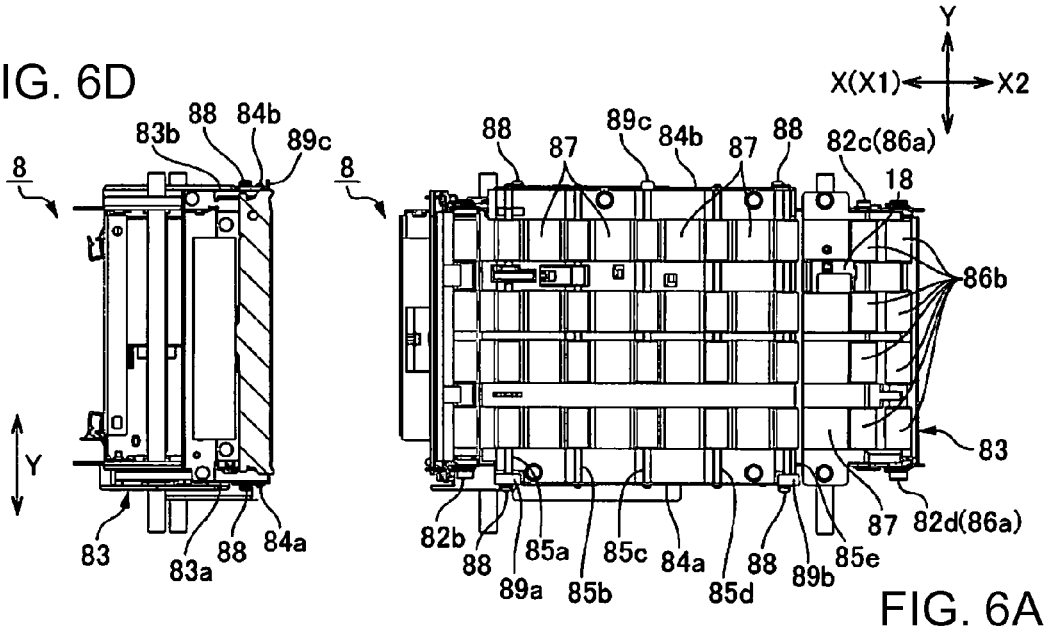
FIG. 6A
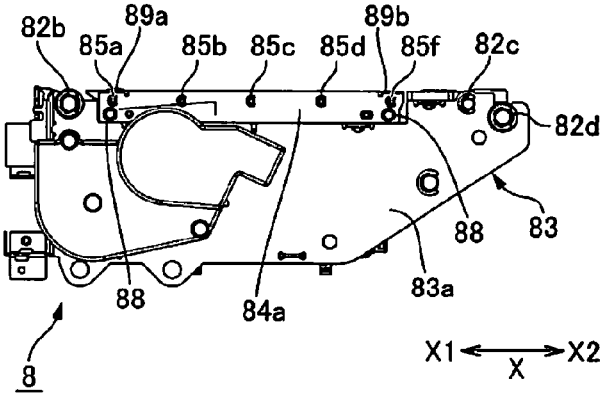
FIG. 6B

FIG. 8C
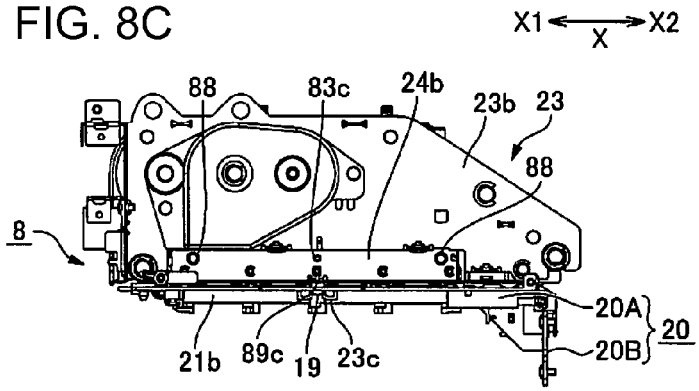
FIG. 8D
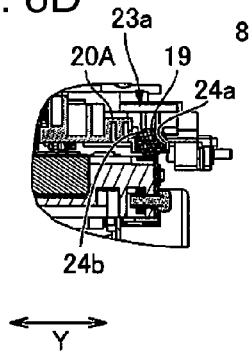
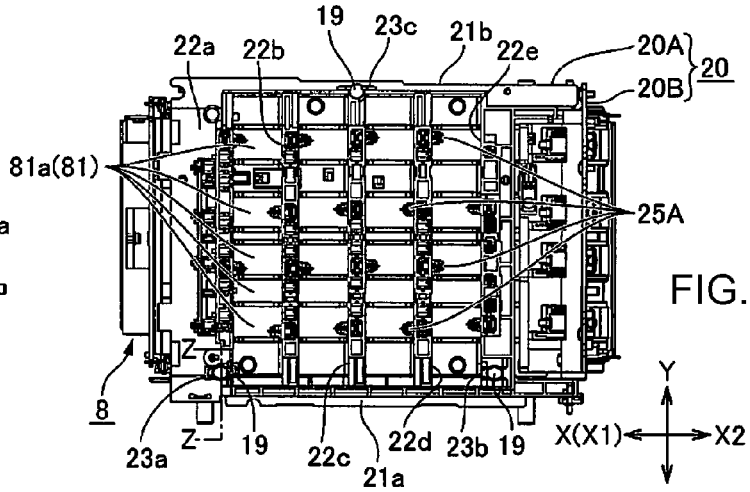
FIG. 8A
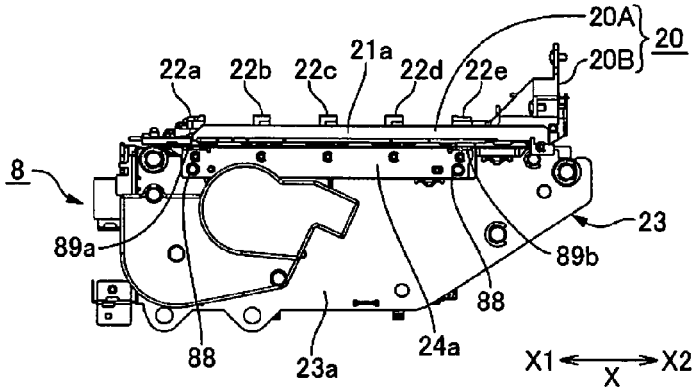
FIG. 8B

PRINTER

Priority is claimed under 35 U.S.C. 119 to Japanese Application No. 2013-233738 filed on Nov. 12, 2013 and to Japanese Application No. 2013-266622 filed on Dec. 25, 2013, which are hereby incorporated by reference in their entireties.

BACKGROUND

1. Technical Field

The present disclosure relates to a support structure of a star wheel that prevents a sheet medium from lifting away from the platen surface, and to a printer having a star wheel.

2. Related Art

Inkjet printers that use star wheels having pointed tips formed at a regular pitch around the outside edge to prevent sheet media conveyed over the platen surface from lifting away from the platen surface are known from the literature. This type of printer is described in Japan Patent 4274180 and JP-A-2009-262544, for example.

The printer (an inkjet recording device) disclosed in Japan Patent 4274180 has spurs (star wheels) disposed on a head unit that carries a printhead group, and prevents media from lifting away from the conveyance belt by using the spurs (star wheels).

The printer disclosed in JP-A-2009-262544 includes spurs (star wheels) disposed on the housing of the printhead unit. The media is conveyed over a support member (platen) opposite the printhead unit. The roller surface of a drive roller is exposed at the surface of the support member, and the spurs (star wheels) are disposed at a position opposite the drive roller. The media is conveyed while pressed against the drive roller by the spurs (star wheels).

JP-A-H04-164766 discloses an image forming device (printer) having star wheels disposed so that they can roll on a movable shaft between levered support brackets. The support brackets can pivot up and down on a support shaft disposed at the top of the printer, but because there is a fixed arm that supports the movable shaft from below, the star wheels rise with the movable shaft and the conveyance path opens when the top of the printer is lifted up. When the top of the printer is closed, the tips of the star wheels contact the paper resting on the conveyance surface of the paper conveyance belt, and the paper is prevented from lifting up.

In line printers that have a printhead that is wider than the width of the recording paper and print with the printhead in a stationary position above the recording paper, the head unit that supports the printhead on the carriage is necessarily large. If the star wheels are mounted on the large head unit, the head unit becomes even larger, and the structure of the carriage that supports the printhead becomes more complicated. As the head unit becomes larger, the output of the carriage motor that drives the carriage must also be increased, further increasing cost. In addition, when the star wheels are mounted on the head unit, the star wheels also move when the head unit is retracted from above the platen. Keeping the star wheels always in the same place therefore may not be possible.

The conveyance path of the printer can be opened to remove paper jams and for other maintenance, for example. However, when printing is interrupted by a paper jam, for example, in a printer that holds the media depressed with star wheels, the star wheels may be exposed when the conveyance path is open. This can create problems, including interfering with removing paper jams and performing other maintenance tasks.

In the printer disclosed in JP-A-H04-164766, the star wheels are covered by the support brackets when the conveyance path is open. More specifically, because the movable shaft to which the star wheels are attached can move inside an oval hole formed in the support bracket, the support bracket descends of its own weight and moves to a position below the star wheels when the top unit opens. The star wheels can therefore be covered so they will not be touched.

However, while the configuration taught in JP-A-H04-164766 can prevent exposing the star wheels, the structure of the member (support bracket) covering the star wheels is complicated, and the configuration of parts is complicated. Furthermore, in this configuration, the angular position of the support bracket affects the pressure applied by the star wheels, and the pressure on the paper (media) may vary. Because variation in this pressure affects the paper conveyance load (media conveyance load), media conveyance precision may drop.

SUMMARY

The present disclosure provides a printer that can avoid problems associated with star wheels, namely the increasing of the size of the head unit, and the movement of the position of the star wheels relative to the platen.

The disclosure also provides a printer that has a simple configuration of parts to in a cover member that avoids exposing the star wheels, and prevents media from lifting up when the conveyance path is open without affecting media conveyance.

A printer according to some embodiments includes a platen unit having a platen surface that supports sheet media; a head unit that carries a printhead that prints on the media, and moves between a print position where the printhead is opposite the platen surface, and a retracted position where the printhead is retracted from the print position; a platen top unit superimposed with the platen surface and separated from the platen unit; and star wheels disposed on the platen top unit.

The printer according to this aspect of some embodiments carries the star wheels that limit separation of media from the platen surface on a platen top unit that is disposed at a position over the platen surface and separate from the platen unit instead of on the head unit. By disposing the star wheels separate from the head unit, a drop in the positioning precision of the star wheels to the platen surface as a result of moving the head unit between the print position and the retracted position can be avoided. Furthermore, because increasing the size of the head unit by the star wheels and the support members therefore can be avoided, complicating the head unit support structure also can be avoided, and which prevents the increase in cost due to increasing the output of the carriage motor that drives the head unit.

Preferably, the platen top unit has a plurality of support frame members supporting the star wheels; and when the head unit is at the print position, the ink nozzle face of the printhead is positioned facing the platen surface through a space enclosed by the plural support frame members and the star wheels.

By thus using a plurality of support frame members, star wheels can be disposed across the entire platen surface, and the media can be prevented from lifting away from any part of the platen surface. Ejecting ink onto the media is not obstructed by the star wheels and the support frame members.

Further preferably, the head unit has a printhead lift mechanism that moves the printhead toward and away from the platen surface; the printhead has a distal end part where the ink nozzle face is formed; and when the printhead lift mechanism lowers the printhead to a platen gap holding position holding a specific gap between the printhead and the platen surface, the distal end part of the printhead enters the space.

This configuration can adjust the platen gap without interfering with the platen top unit and the head unit. When moving the head unit to the retracted position, the head unit can also be raised to not interfere with the platen top unit.

In another aspect of some embodiments, the star wheels are preferably disposed on the plural support frame members at different positions in the media conveyance direction.

This configuration prevents the same position on the media being continuously depressed by the star wheels when the media is conveyed. As a result, the star wheels can be prevented from leaving tracks on the media.

In another aspect of some embodiments, teeth are formed on the outside edge of the star wheel; and a wheel cleaner that contacts the tips of the teeth of the star wheel when the tips of the teeth are separated from the medium is disposed on the platen top unit.

This configuration enables the removal of ink and other foreign matter that transferred from the media to the star wheels immediately after printing. Soiling the media by ink and other matter on the star wheels can therefore also be avoided.

Further preferably, the wheel cleaner is a roller having a tubular outside surface; and the roller is disposed so that the outside surface contacts the tips of the teeth, and is supported to rotate following rotation of the star wheel.

This configuration suppresses interference with rotation of the star wheels by the cleaning operation. The entire outside surface of the roller can also be used as a cleaning surface.

Further preferably, an urging member that urges the star wheel to the platen surface is disposed on the platen top unit; and the roller is supported to move following movement of the star wheel when the star wheel moves in the urging direction of the urging member.

This configuration can reliably keep the media pressed to the platen surface by the star wheels. The tips of the teeth from the star wheels can also be kept in constant contact with the wheel cleaner (roller).

In another aspect of some embodiments, the platen top unit is fastened to the main printer frame.

This configuration can hold the platen top unit in a fixed location.

A printer according to another aspect of some embodiments has a platen unit that moves between an opposing position forming a specific gap between the platen surface and the printhead, and an open position where the platen surface is further from the printhead than at the opposing position; and a cover member that is set to a cover position protruding further to the platen surface side than the star wheel when the platen unit is in the open position, and is set to a retracted position separated further from the platen surface than the star wheel when the platen unit is in the opposing position.

The disclosure also has a cover member that moves between a cover position preventing exposure of the star wheels, and a retracted position not obstructing contact with the star wheels, in conjunction with the opening and closing operation of the platen unit. Exposing the star wheels when the media conveyance path is open can therefore be avoided.

Preferably, the cover member descends of its own weight to the cover position when the platen unit moves from the opposing position to the open position; and the cover member is pushed up by the platen unit from the cover position to the retracted position when the platen unit moves from the open position to the opposing position.

Thus comprised, a separate mechanism for moving the cover member is not needed, the configuration of parts can be simplified, and space can be saved.

Further preferably, the cover member is supported pivotably up and down on one end. This configuration simplifies the support structure of the cover member.

Further preferably in another aspect of some embodiments, the cover member also has a cover frame; and when the cover member moves to the retracted position, the support frame enters a channel portion of the cover frame.

This configuration does not need a retraction space for the cover frame outside the platen top unit. Space can therefore be saved.

Further preferably, the printer also has a locking mechanism that locks the cover so that it cannot move to the retracted position side when the cover member is at the cover position. This prevents the cover member from moving and the star wheels being exposed when the cover member is pushed by hand.

More specifically, the locking mechanism includes a lock member that is attached pivotably to the cover member and can pivot to a lock position where one endpoints in a direction projecting from the cover member to the opposite side as the platen unit, and a release position where the one endpoints in a direction not projecting from the cover member to the opposite side as the platen unit; an urging member that urges the lock member to the lock position; and a lock member stop disposed on the platen unit at a position opposite the one end of the lock member in the lock position.

When the cover member moves to the cover position in this configuration, the lock member pivots and can contact the lock member stop due to the urging force of the urging member. As a result, the cover member can be prevented from moving to the retracted position side.

Other objects and attainments together with a fuller understanding of some embodiments will become apparent and appreciated by referring to the following description and claims taken in conjunction with the accompanying drawings.

BRIEF DESCRIPTION OF THE DRAWINGS

FIGS. 6A-6D illustrate the platen unit without the conveyance belt.

FIGS. 8A-8D illustrate when the platen top unit is disposed above the platen unit.

DESCRIPTION OF EMBODIMENTS

A preferred embodiment of a printer according to the present disclosure is described below with reference to the accompanying figures. While the following embodiments apply the disclosure to a printer that prints on loaded roll paper, the disclosure can also be applied to printers that print on other types of media.

General Configuration

Figure 1:
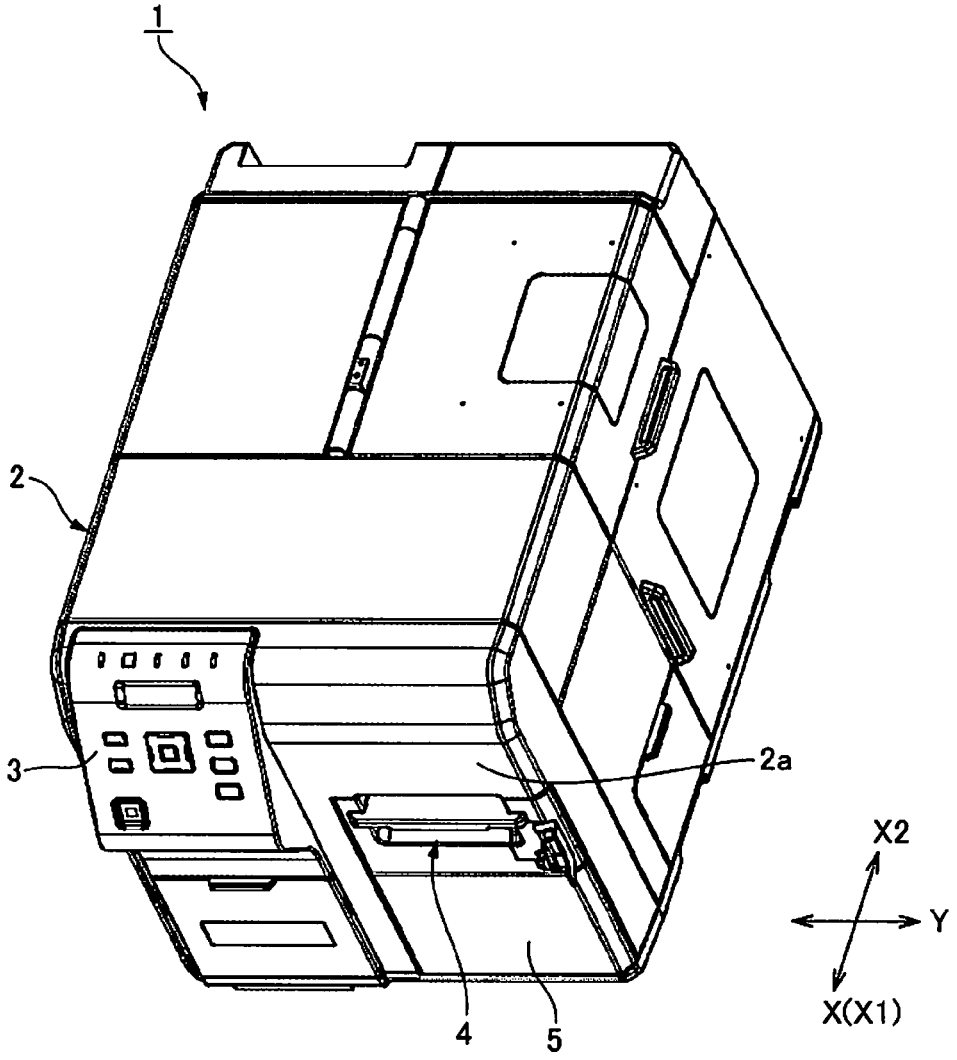
FIG. 1 is an external oblique view of an inkjet line printer according to a preferred embodiment of the disclosure.
Figure 2:
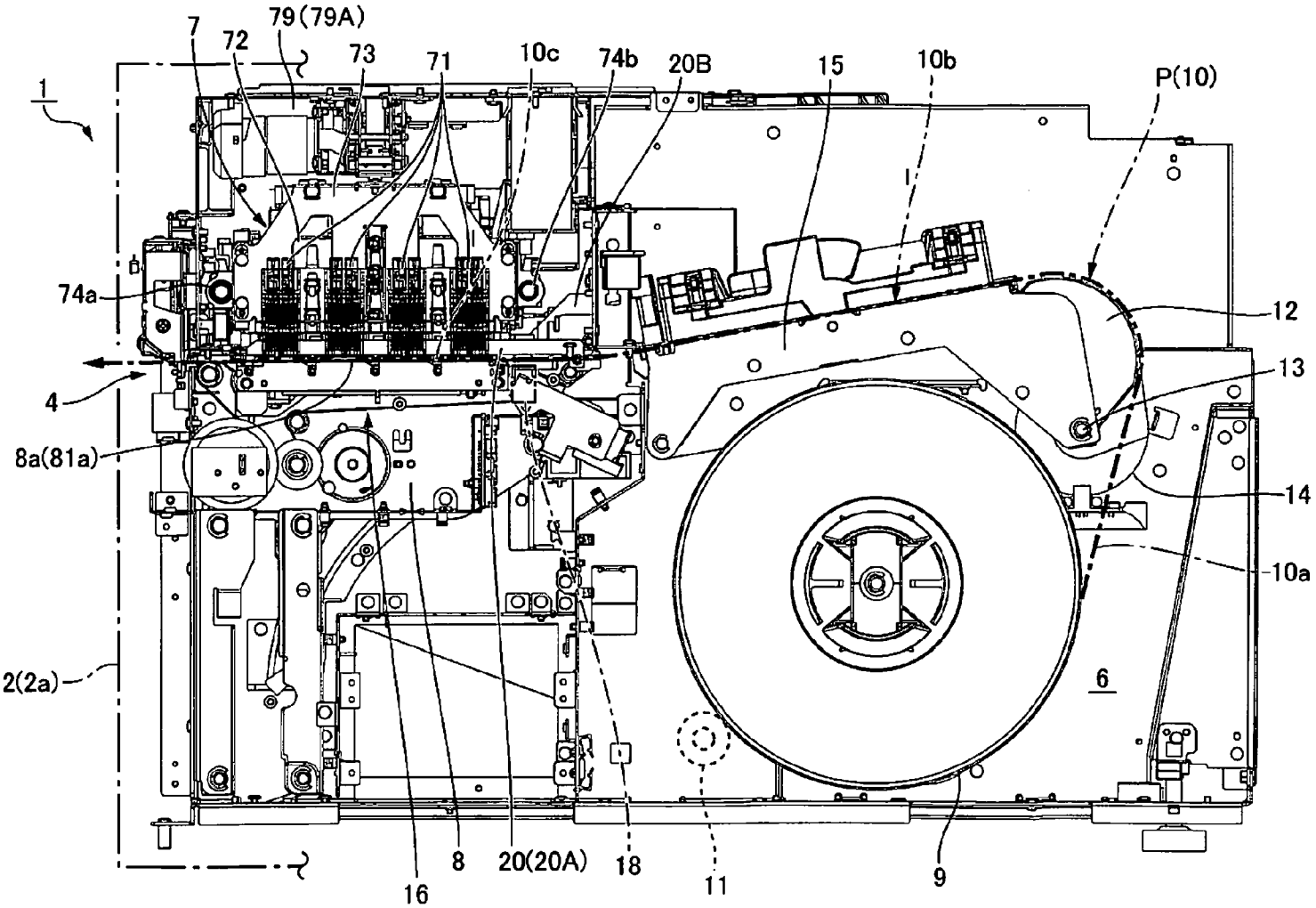
FIG. 2 is a vertical section view showing the internal configuration of the inkjet line printer in FIG. 1.

FIG. 1 is an external oblique view of an inkjet line printer according to the disclosure, and FIG. 2 is a vertical section view showing the internal configuration of the printer.

As shown in FIG. 1, the inkjet line printer 1 (below, printer 1) has a printer cabinet 2 that is basically box-shaped. An operating panel 3 is disposed to one side of the device width, and a paper exit 4 is formed on the other side. An access cover 5 for maintenance is disposed below the paper exit 4.

As shown in FIG. 1, the direction between the front and back of the printer is indicated by arrow X, and the direction across the printer width is indicated by arrow Y. The front of the printer is denoted X1, and the back of the printer as X2.

As shown in FIG. 2, a roll paper compartment 6 is located at the back X2 inside the printer cabinet 2. A head unit 7 is located at the top of the front X1, and a platen unit 8 is located therebelow.

The head unit 7 includes a printhead 71, which can be an inkjet line head. An ink nozzle row that ejects ink droplets is formed in the printhead 71. The length of the ink nozzle row covers the maximum width of the continuous paper P that is delivered from the paper roll 9 loaded in the roll paper compartment 6. The platen unit 8 has a platen surface 8*a* parallel to and opposite the nozzle face of the printhead 71. The platen surface 8*a* is embodied by the horizontal belt portion 81*a* of the conveyance belt 81 described below.

Inside the printer cabinet 2, the continuous paper P pulled from the paper roll 9 in the roll paper compartment 6 is conveyed through the conveyance path 10 indicated by the bold dot-dash line past the print position of the printhead 71 toward the paper exit 4 opened in the front 2*a* of the printer cabinet 2, and is discharged from the paper exit 4.

The paper conveyance path 10 includes a first conveyance path section 10*a* that extends diagonally upward toward the back X2; a second conveyance path section 10*b* that curves from the top end of the first conveyance path section 10*a* toward the front X1 and descends gradually to the platen surface 8*a*; and a third conveyance path section 10*c* that extends horizontally from the back X2 end of the platen surface 8*a* to the front X1 of the printer. The print position of the printhead 71 is in the middle of the third conveyance path section 10*c*.

A media supply roller 11 is disposed at the bottom part of the roll paper compartment 6. The media supply roller 11 is held in constant contact with the paper roll 9 in the roll paper compartment 6 from below. The continuous paper P is delivered from the paper roll 9 to the first conveyance path section 10*a* by rotationally driving the media supply roller 11 with a supply motor (not shown in the figure). Note that the continuous paper P may alternatively be supplied by installing the paper roll 9 on a rotating shaft and rotationally driving the rotating shaft by means of the supply motor.

A tension lever 12 that applies back tension to the continuous paper P is disposed where the conveyance path 10 changes direction from the first conveyance path section 10*a* to the second conveyance path section 10*b*. The distal end of the tension lever 12 has a curved outside surface, and the continuous paper P is mounted thereon. The tension lever 12 is attached pivotably around a predetermined axis of rotation 13. A spring member (not shown in the figure) is attached to the tension lever 12 at a position separated from the axis of rotation 13. This spring member is held by the printer cabinet frame, and urges the tension lever 12 to the back direction. More specifically, the tension lever 12 is urged in a direction that increases tension on the continuous paper P. Note that a sliding tension lever can be used instead of a pivoting tension lever 12.

A rotary encoder 14 is disposed on the axis of rotation 13 of the tension lever 12. The rotary encoder 14 can detect the angular position of the tension lever 12 continuously or in multiple steps, and could be an optical sensor such as an optical potentiometer, a magnetic sensor, or other type of sensor. By detecting the angular position of the tension lever 12 by the rotary encoder 14, change in the continuous paper P tension can be monitored, and conveyance can be controlled to maintain desirable tension.

A paper guide 15 is disposed on the front side of the tension lever 12 along the second conveyance path section 10*b*. The paper guide 15 is shaped to descend gradually toward the front (X1 direction), and guides the continuous paper P from the tension lever 12 to the platen surface 8*a*.

Figure 3:
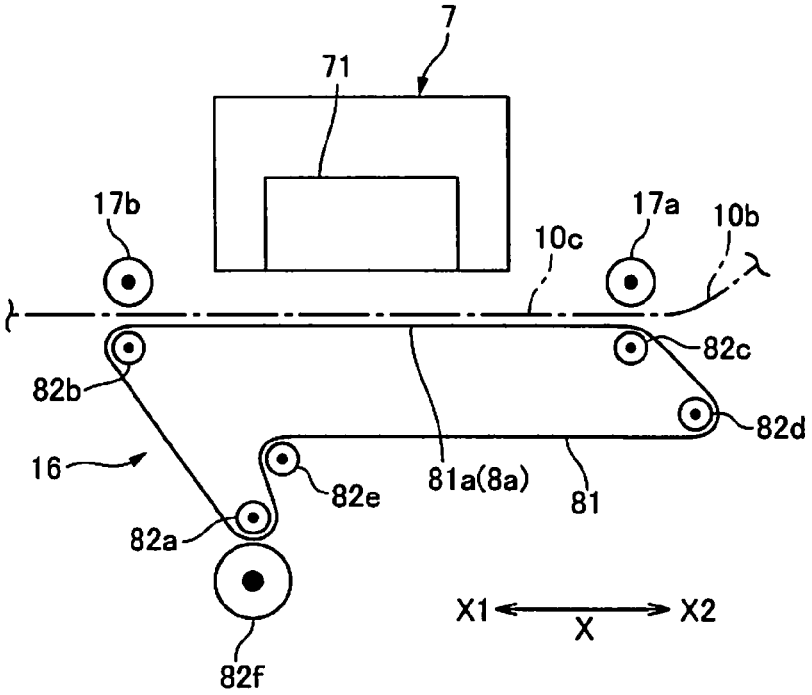
FIG. 3 schematically illustrates the paper conveyance mechanism.

A belt-type media conveyance mechanism 16 is disposed along the third conveyance path section 10*c*. FIG. 3 schematically illustrates the media conveyance mechanism 16. The media conveyance mechanism 16 includes a conveyance belt 81, which is an endless belt, disposed below the third conveyance path section 10*c*; a plurality of guide rollers 82*a* to 82*e* on which the conveyance belt 81 is mounted; a drive roller 82*f* that drives the conveyance belt 81; and a conveyance motor (not shown in the figure) that rotationally drives the drive roller 82*f*. The conveyance belt 81 is pressed to the drive roller 82*f* by guide roller 82*a*. By turning the drive roller 82*f*, the conveyance belt 81 moves through a path past the guide rollers 82*a* to 82*e*. An encoder (not shown in the figure) that detects the angle of rotation is attached to the rotary shaft of the drive roller 82*f*.

The portion of the conveyance belt 81 between guide rollers 82*b* and 82*c* is the horizontal belt portion 81*a* extending horizontally through the third conveyance path section 10*c*. Pinch rollers 17*a*, 17*b* are pressed from the same side as the head unit 7 to the upstream end and the downstream end of the horizontal belt portion 81*a* in the conveyance direction (that is, in the direction of the longitudinal axis X). The media conveyance mechanism 16 holds and conveys the continuous paper P between the pinch rollers 17*a*, 17*b* and the horizontal belt portion 81*a*.

Figure 4:
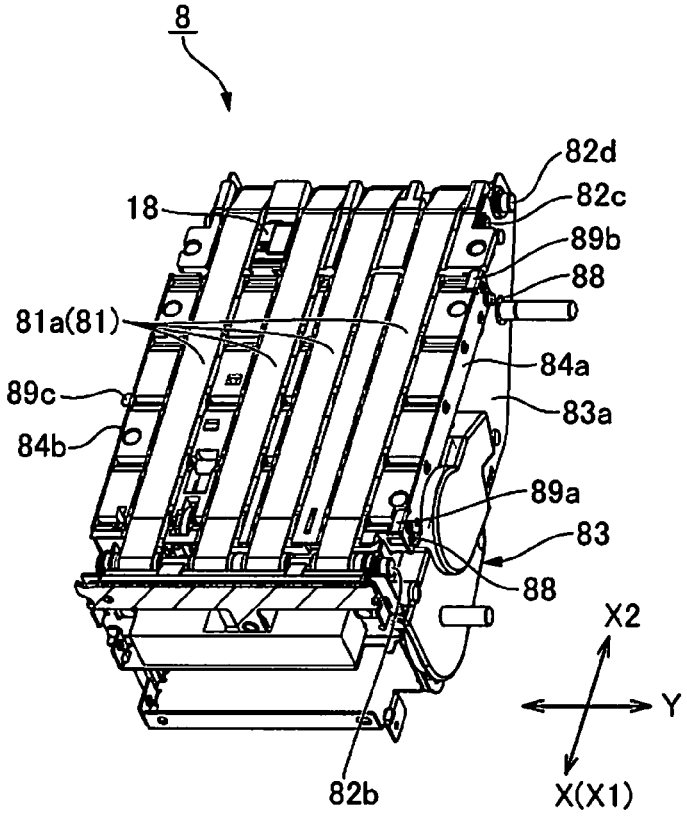
FIG. 4 is an oblique view of the platen unit.
Figure 5:
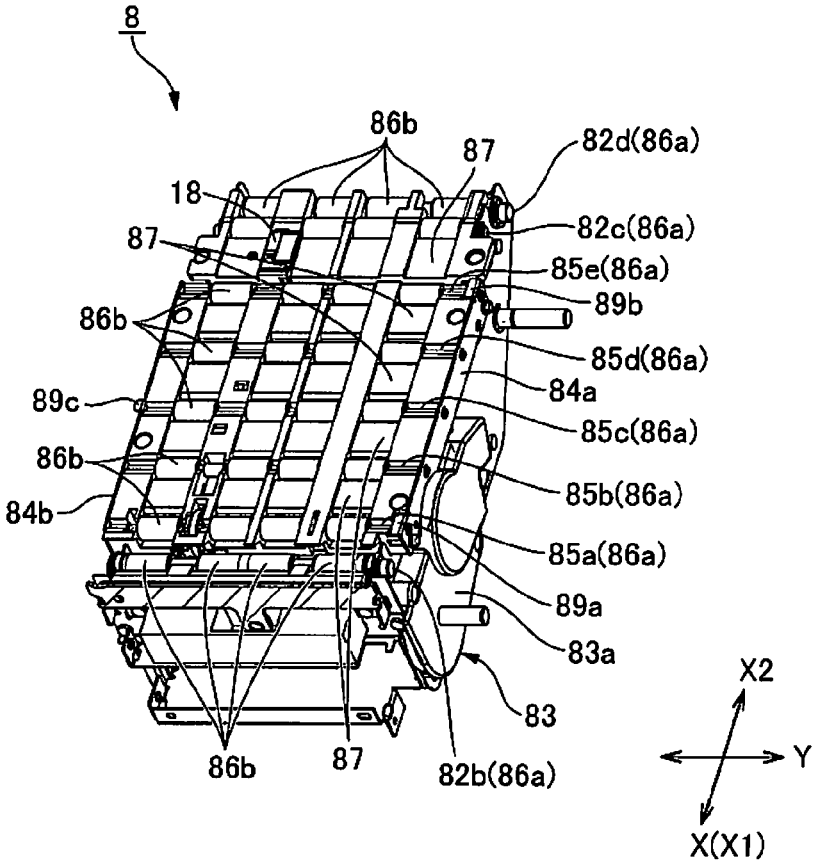
FIG. 5 is an oblique view of the platen unit without the conveyance belt.

As shown in FIGS. 4 and 5 a paper detector 18 that detects the continuous paper P conveyed over the platen surface 8*a* is disposed on the platen unit 8. The detection position of the paper detector 18 is disposed on the third conveyance path section 10*c* on the upstream side (that is, towards the back direction X2) of the print position of the printhead 71. As shown in FIG. 2, the continuous paper P is pulled from the paper roll 9 in the roll paper compartment 6 through the first conveyance path section 10*a* of the conveyance path 10, around the tension lever 12, and set with the leading end extending along the second conveyance path section 10*b*. An indexing operation that supplies the continuous paper P using the media supply roller 11, conveys the paper with the media conveyance mechanism 16, and sets the leading end of the continuous paper P to the print position of the printhead 71 is then executed. The continuous paper P is then conveyed continuously at a constant speed in the forward conveyance direction from the print position to the paper exit 4 by the media conveyance mechanism 16. Synchronized to this conveyance operation, the printhead 71 is driven to print on the surface of the continuous paper P passing the print position.

FIG. 4 is an oblique view of the platen unit 8, and FIG. 5 is an oblique view of the platen unit 8 without the conveyance belt 81. FIGS. 6A-6D illustrate the platen unit 8 without the conveyance belt, FIG. 6A being a plan view, FIGS. 6C and 6C being side views from one side and the other side on the transverse axis Y, and FIG. 6D being a front view from the front of the printer.

As shown in FIG. 4, the horizontal belt portions 81*a* of four conveyance belts 81 extend along the longitudinal axis X on the top of the platen unit 8 opposite the head unit 7. The horizontal belt portion 81*a* is the portion of the conveyance belt 81 that is mounted between the guide roller 82*b* disposed on the front end of the platen unit 8, and the guide roller 82*c* disposed on the back end of the platen unit 8. A guide roller 82*d* is also disposed on the back side of the guide roller 82*c*. The conveyance belt 81 is mounted at a downward angle from the upstream end of the horizontal belt portion 81*a* between the guide roller 82*c* and guide roller 82*d*.

The platen unit 8 includes a platen unit body 83 made of sheet metal, for example. The platen unit body 83 has side frames 83*a*, 83*b* forming one side and another side of the platen unit 8 on the transverse axis Y. The side frames 83*a*, 83*b* support the guide rollers 82*a* to 82*e* on which the conveyance belt 81 is mounted, and the drive roller 82*f* (see FIG. 3) that drives the conveyance belt 81. A conveyance motor is disposed inside the platen unit body 83.

A first side bar 84*a* and a second side bar 84*b* are attached parallel to each other at the top edge of the side frames 83*a*, 83*b*. The first side bar 84*a* and second side bar 84*b* are rectangular plates that extend horizontally along the longitudinal axis X. The first side bar 84*a* is affixed by screws 88 to the side frame 83*a* at two places at the opposite ends of the length of the side bar 84*a* (that is, in the direction of the longitudinal axis X). The second side bar 84*b* is attached so that it can rock on a support pin 83*c* disposed on the platen unit body 83, and after being set parallel to the first side bar 84*a*, the second side bar 84*b* is fastened by screws 88 to the side frame 83*b* at two places on opposite lengthwise ends.

As shown in FIG. 5 and FIGS. 6A-6D, the first side bar 84*a* and second side bar 84*b* support the ends of five support rollers 85*a* to 85*e*, which extend parallel to the transverse axis Y. The five support rollers 85*a* to 85*e*, and guide rollers 82*b*, 82*c*, 82*d* each include a roller body 86*b* that supports the conveyance belt 81, and an axle 86*a* on which the roller body 86*b* can rotate. The roller bodies 86*b* are arrayed in four rows that extend in the direction of the longitudinal axis X on the top of the platen unit 8, and a horizontal belt portion 81*a* is mounted on each row. A holder 87 is disposed on the top of the platen unit 8 in the spaces where the axles 86*a* and roller bodies 86*b* are not disposed.

Of the four horizontal belt portions 81*a*, a gap is formed between the horizontal belt portion 81*a* located closest to the first side bar 84*a* and the adjacent horizontal belt portion 81*a*, and the detector part of the paper detector 18 described above is exposed in this gap at a position near the back. An optical sensor, for example, can be used as the paper detector 18. The paper detector 18 detects the continuous paper P through this gap in the horizontal belt portions 81*a*.

Platen Opening and Closing Mechanism

Figure 16A:
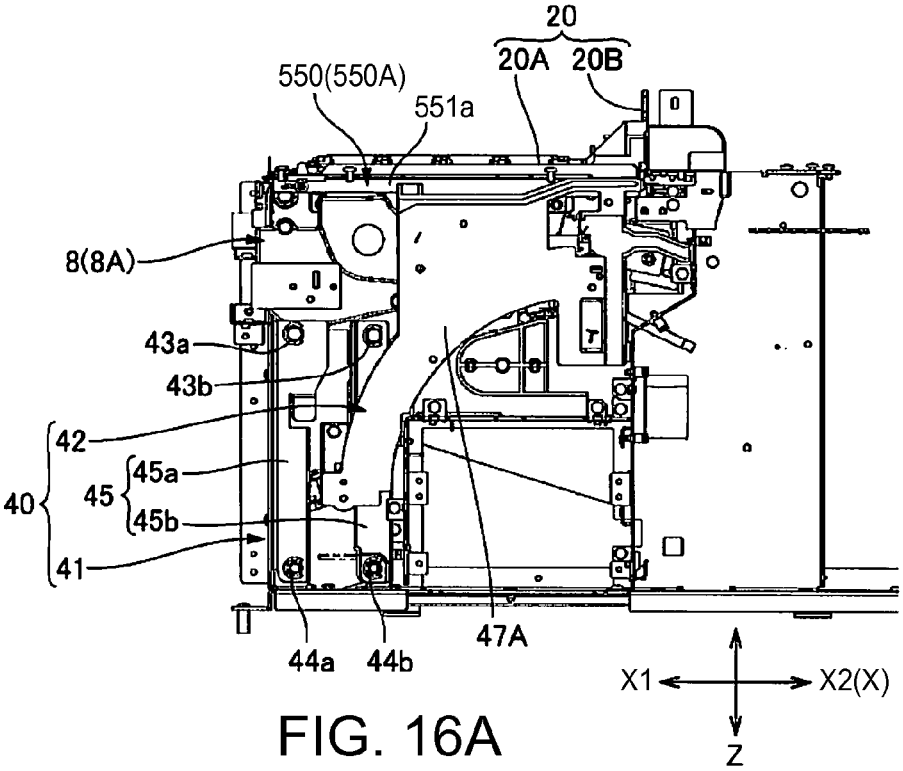
FIGS. 16A and 16B are side views of the platen unit when open and closed.
Figure 16B:
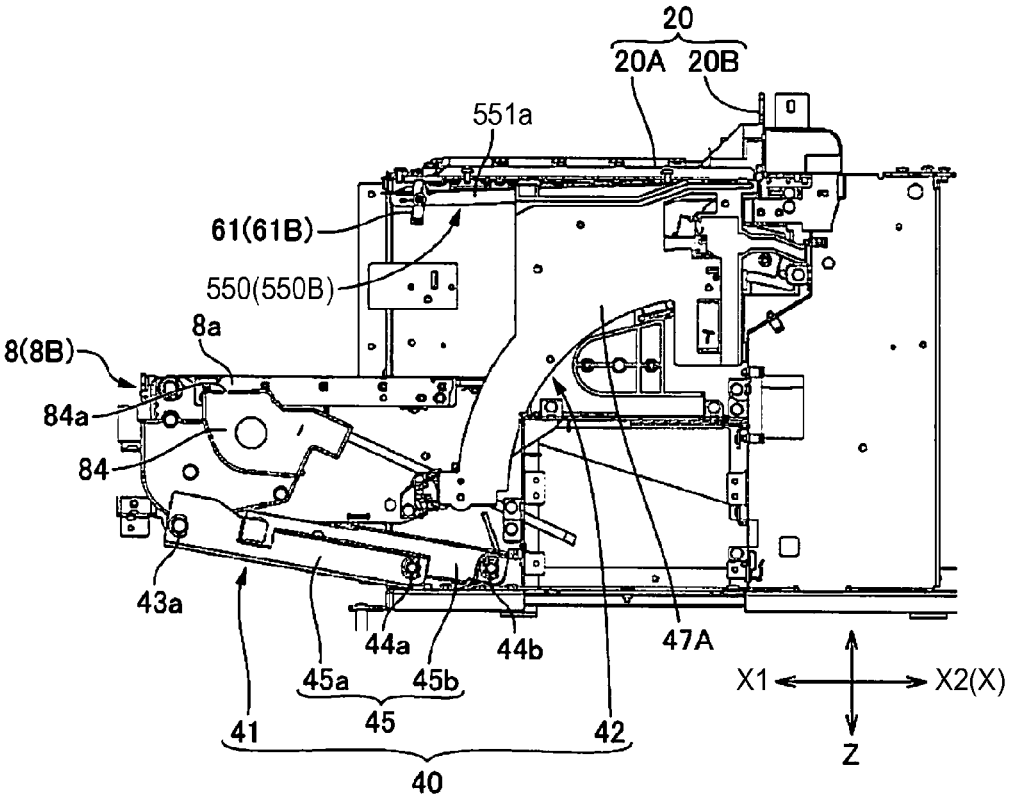
Figure 17A:
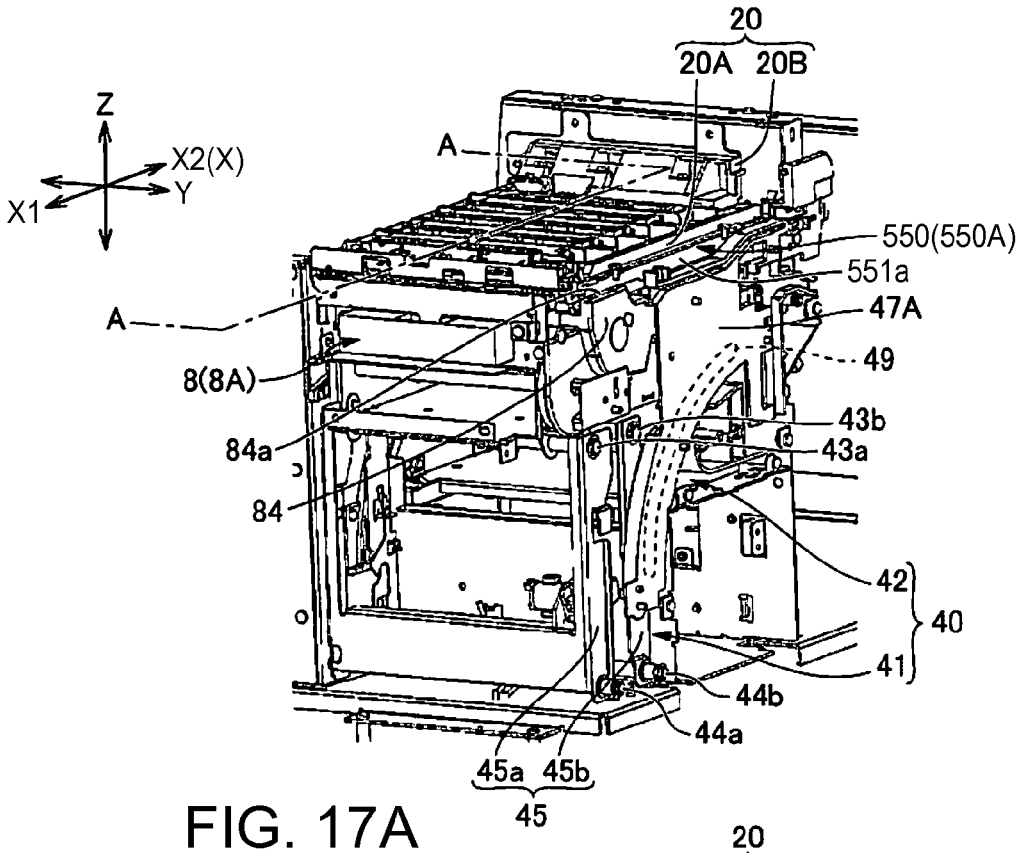
FIGS. 17A and 17B are oblique views of the platen unit when open and closed.
Figure 17B:
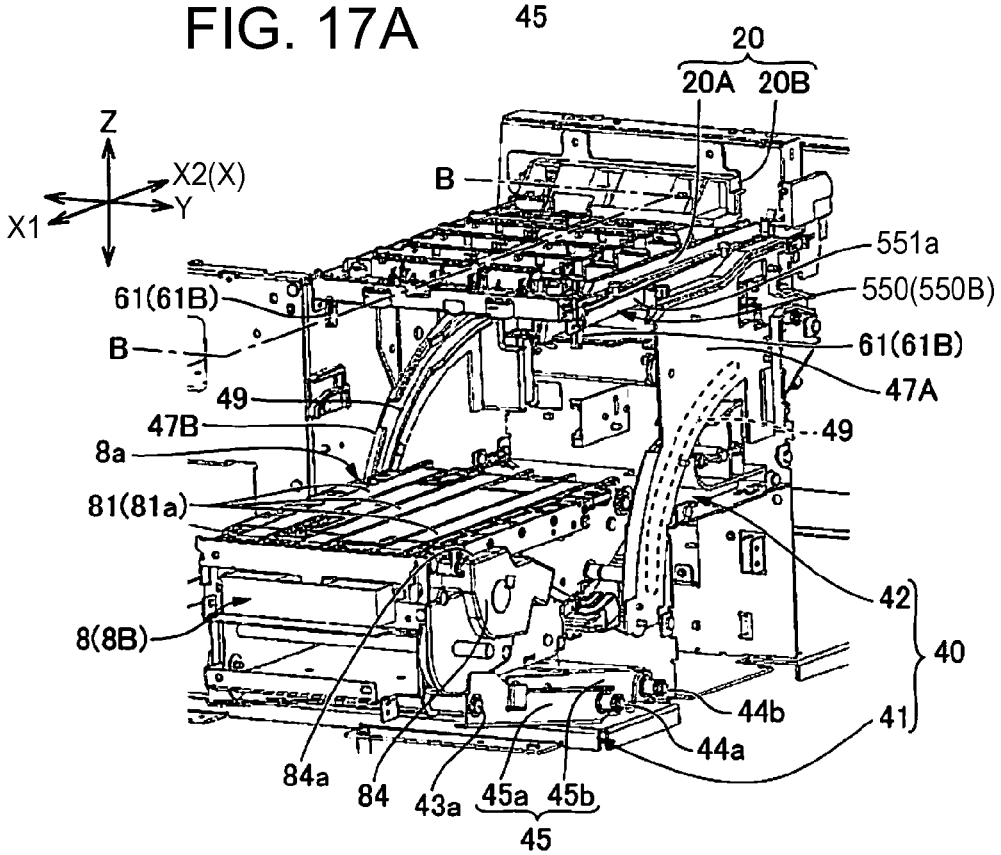

FIGS. 16A and 16B and FIG. 17B show part of the internal mechanism of the printer 1, FIGS. 16A and 16B being side views and FIGS. 17A and 17B being an oblique views showing the platen unit 8 when open and closed. In FIGS. 16A, 16B and FIG. 17A shows the platen unit 8 in the opposing position 8A facing the head unit 7, and FIG. 17B shows the platen unit 8 when pulled to the front and lowered to the open position 8B.

The platen opening mechanism 40 includes a linkage mechanism 41 that supports the platen unit 8 near the front (towards direction X1), and a guide mechanism 42 that supports the platen unit 8 near the back (toward direction X2). Note that the right side and left side are the right side and left side when looking at the printer 1 from the front X1 to the back X2.

As shown in FIGS. 16A and 16B, the linkage mechanism 41 is a parallel linkage mechanism including a right link 45 including a first right link 45*a* and a second right link 45*b* disposed on the right side of the platen unit 8, and a left link (not shown in the figure) including a first left link (not shown in the figures) and a second left link (not shown in the figures) disposed on the left side of the platen unit 8. The left link is left-right symmetrical to the right link 45. Top support shafts 43*a*, 43*b* extending parallel to the transverse axis Y are disposed at positions at the front of the platen unit 8. Bottom support shafts 44*a*, 44*b* extending parallel to the transverse axis Y are disposed at the bottom of the printer cabinet 2. The first right link 45*a* connects the right side ends of the top support shaft 43*a* and the bottom support shaft 44*a*, and the second right link 45*b* connects the right side ends of the top support shaft 43*b* and the bottom support shaft 44*b*. The first left link (not shown in the figure) connects the left side ends of the top support shaft 43*a* and the bottom support shaft 44*a*, and the second left link (not shown in the figure) connects the left side ends of the top support shaft 43*b* and the bottom support shaft 44*b*. The connections between the links and support shafts are hinged joints.

The guide mechanism 42 includes a right frame 47A disposed along the right side surface of the printer cabinet 2, a left frame 47B (see FIG. 17B) disposed along the left side surface of the printer cabinet 2, and a guide rail (not shown in the figure) attached to the platen unit 8 near the back X2.

The right frame 47A is fixed to the main frame of the printer 1. The bottom end of the right frame 47A is curved and descends toward the front. A curved guide channel 49 (see FIGS. 17A and 17B) is formed along this curved part on the inside surface on the transverse axis Y.

The left frame 47B is left-right symmetrical to the right frame 47A, and comprises a curved guide channel 49 that is formed on the left frame 47B opposite the curved guide channel 49 of the right frame 47A on the transverse axis Y. The left and right ends of the guide rail 48 are inserted to these curved guide channels 49.

As shown in FIG. 16A and FIG. 17A, when the platen unit 8 is at the opposing position 8A, the four links embodying the right link 45 and left link are standing in an upright position on the vertical axis Z. The guide rail 48 is positioned at the ends of the curved guide channels 49 at the back X2 of the printer.

When the platen unit 8 is pulled out toward the front direction, the right link 45 and the left link of the linkage mechanism 41 pivot at the bottom ends thereof to the front. As a result, the platen unit 8 moves along a curved path to the open position 8B while the platen surface 8*a* remains facing the top of the printer. The guide mechanism 42 follows the movement of the linkage mechanism 41 with the guide rail 48 moving along the curved guide channels 49, moving through the curved path of movement while supporting the back end of the platen unit 8.

As shown in FIGS. 16A, 16B, 17A and FIG. 17B, the platen top unit 20 disposed on the top of the platen unit 8 remains in the same position and does not move when the platen unit 8 moves from the opposing position 8A to the open position 8B. The gap between the platen unit 8 and the platen top unit 20 is therefore wide at the open position 8B, and the third conveyance path section 10*c* of the conveyance path 10 is open to the front. As a result, the user can easily insert a hand to remove paper jammed between the platen top unit 20 and the platen unit 8, for example.

Forming the Platen Gap

Three bearing balls 19 (see FIG. 7 and FIGS. 8A-8D) are disposed between the platen unit 8 and the head unit 7. A specific gap (platen gap) is held between the nozzle face of the printhead 71 and the platen surface 8*a* when the platen unit 8 contacts the bearing balls 19 from below and the head unit 7 contacts the bearing balls 19 from above. Parts that contact the bearing balls 19 on the platen unit 8 side are formed in the first side bar 84*a* and the second side bar 84*b*. More specifically, as shown in FIG. 4 to FIG. 6D, platen-side stops 89*a*, 89*b* are formed at two locations at the lengthwise ends of the top of the first side bar 84*a*.

The platen-side stops 89*a*, 89*b* are flat members that bend substantially perpendicularly from the top edge of the first sidebar 84*a* and extend toward the widthwise middle of the platen surface 8*a*. Another platen-side stop 89*c* is formed at one place in the lengthwise middle of the top edge of the second side bar 84*b*. The platen-side stop 89*c* also bends substantially perpendicularly from the top edge of the second side bar 84*b* and extends toward the outside widthwise to the platen surface 8*a*. One of the three bearing balls 19 contacts each of the platen-side stops 89*a*, 89*b*, 89*c*.

Figure 7:
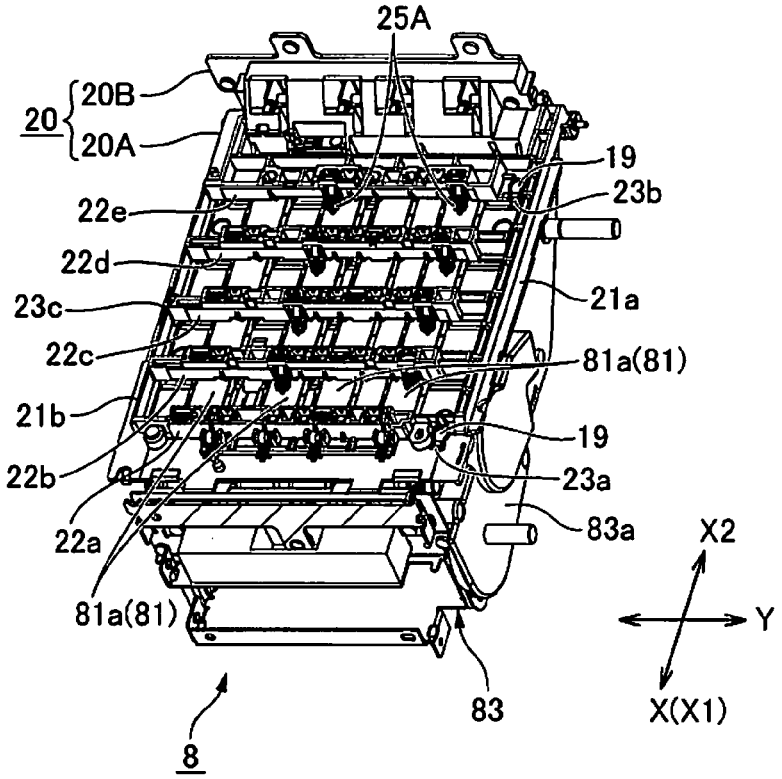
FIG. 7 is an oblique view showing the platen top unit disposed above the platen unit.

FIG. 7 is an oblique view showing the platen unit 8 with the platen top unit 20 installed. FIGS. 8A-8D illustrate the platen unit 8 with the platen top unit 20 installed, FIG. 8A being a plan view, FIGS. 8B and 8C being side views from one side and the other side on the transverse axis Y, and FIG. 8D being a section view on the vertical axis Z through the ball holding unit.

Figure 9A:
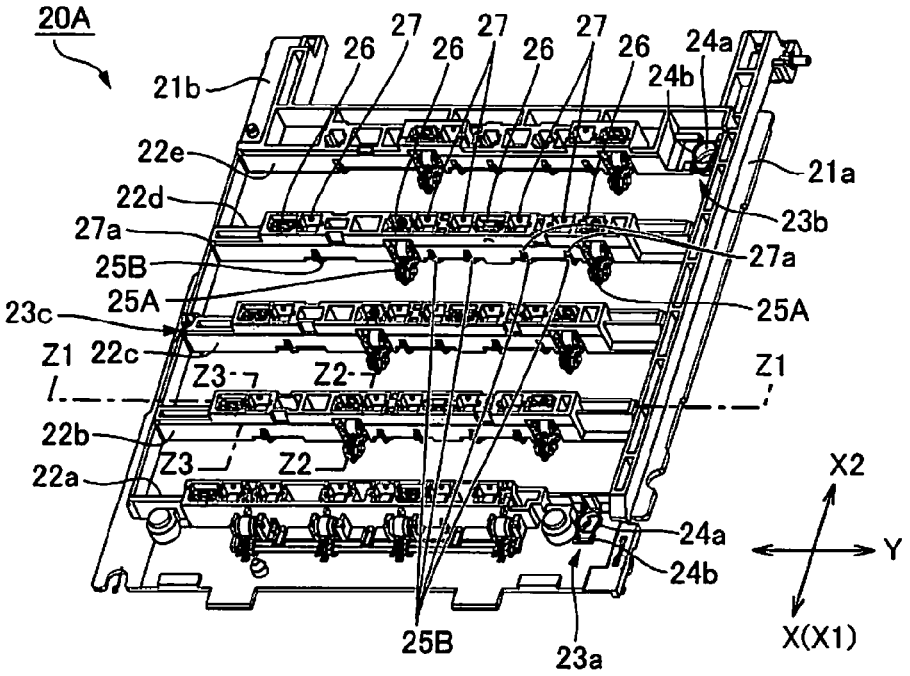
FIGS. 9A and 9B illustrate the top unit body.
Figure 9B:
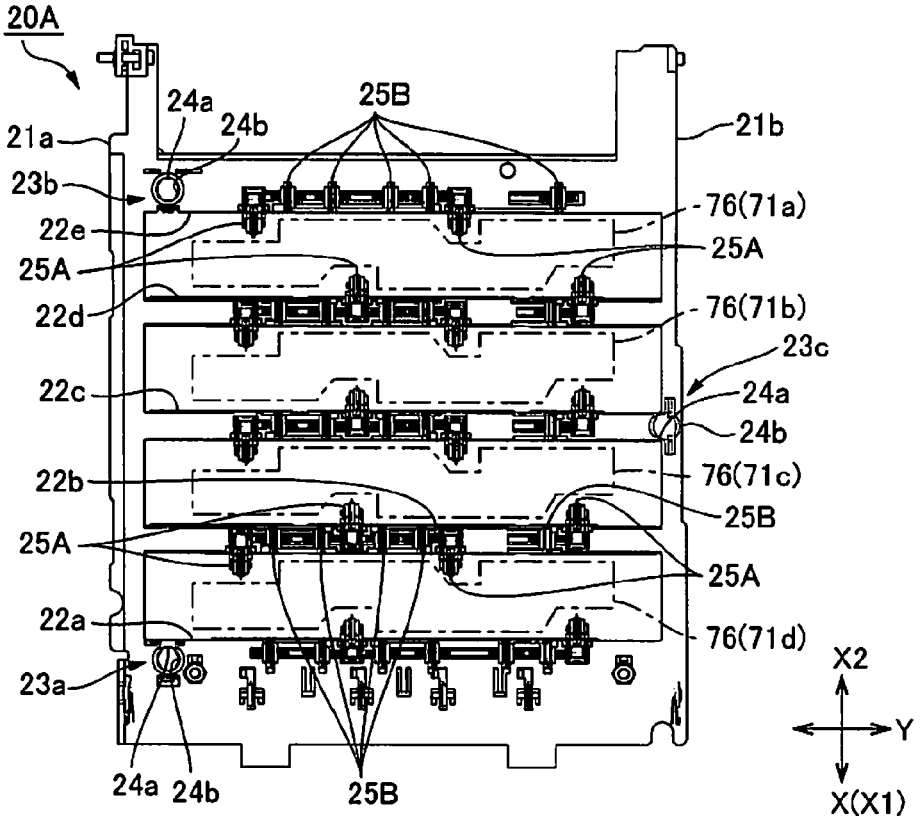

FIGS. 9A and 9B illustrate the top unit body of the platen top unit 20, FIG. 9A being an oblique view and FIG. 9B being a bottom view from the platen unit 8 side.

As shown in FIG. 2, the platen top unit 20 is disposed between the platen unit 8 and the head unit 7. The bearing balls 19 are held in the platen top unit 20.

As shown in FIG. 7 to FIG. 9B, the platen top unit 20 has a generally rectangular flat shape. The platen top unit 20 is disposed above the platen unit 8, and includes a thin top unit body 20A superimposed with the platen surface 8*a* from above without touching the platen surface 8*a*, and a support frame 20B attached to the back end of the top unit body 20A. The platen top unit 20 is fastened to the main frame of the printer 1 through the support frame 20B.

The top unit body 20A includes a pair of longitudinal frame members 21*a*, 21*b* extending parallel to the longitudinal axis X along the side frames 83*a*, 83*b* of the platen unit 8; and five horizontal frame members 22*a* to 22*e* (support frames) disposed over the five support rollers 85*a* to 85*e* of the platen unit 8. The horizontal frame members 22*a* to 22*e* extend parallel to the transverse axis Y intersecting the conveyance direction of the continuous paper P, and the ends are connected to the longitudinal frame members 21*a*, 21*b*. As shown in FIGS. 9A and 9B, the back ends of the longitudinal frame members 21*a*, 21*b* protrude further to the back side than the horizontal frame member 22*e* that is closest to the back, and the support frame 20B is attached to these ends of the longitudinal frame members 21*a*, 21*b*.

Bearing ball holders 23*a* to 23*c* are formed at three locations on the top unit body 20A where the three bearing balls 19 are held. The bearing ball holders 23*a* to 23*c* are formed at positions corresponding to the platen-side stops 89*a* to 89*c* described above, bearing ball holder 23*a* and 23*b* being formed at two locations on one longitudinal frame member 21*a*, and bearing ball holder 23*c* formed at one place on the longitudinal frame member 21*b*. As shown in FIG. 8D, the bearing ball holder 23*a* includes a round through-hole 24*a* passing on the vertical axis Z through the longitudinal frame member 21*b*; and a wire support member 24*b* attached to support the ball 19 of the through-hole 24*a* so that the ball 19 can roll freely. The bearing ball holders 23*b*, 23*c* are identically configured.

Figure 10:
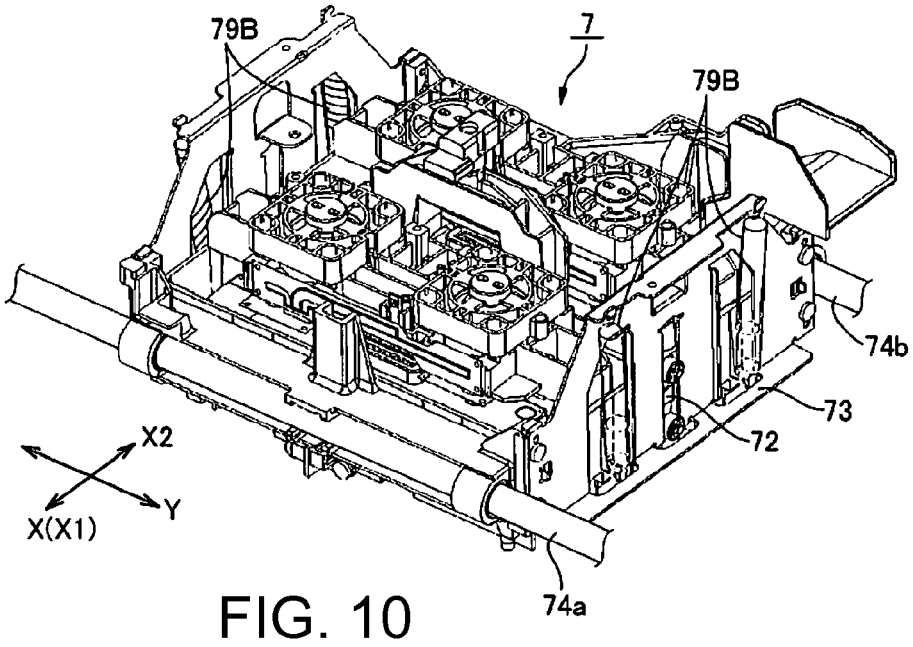
FIG. 10 is an oblique view of the head unit.
Figure 11:
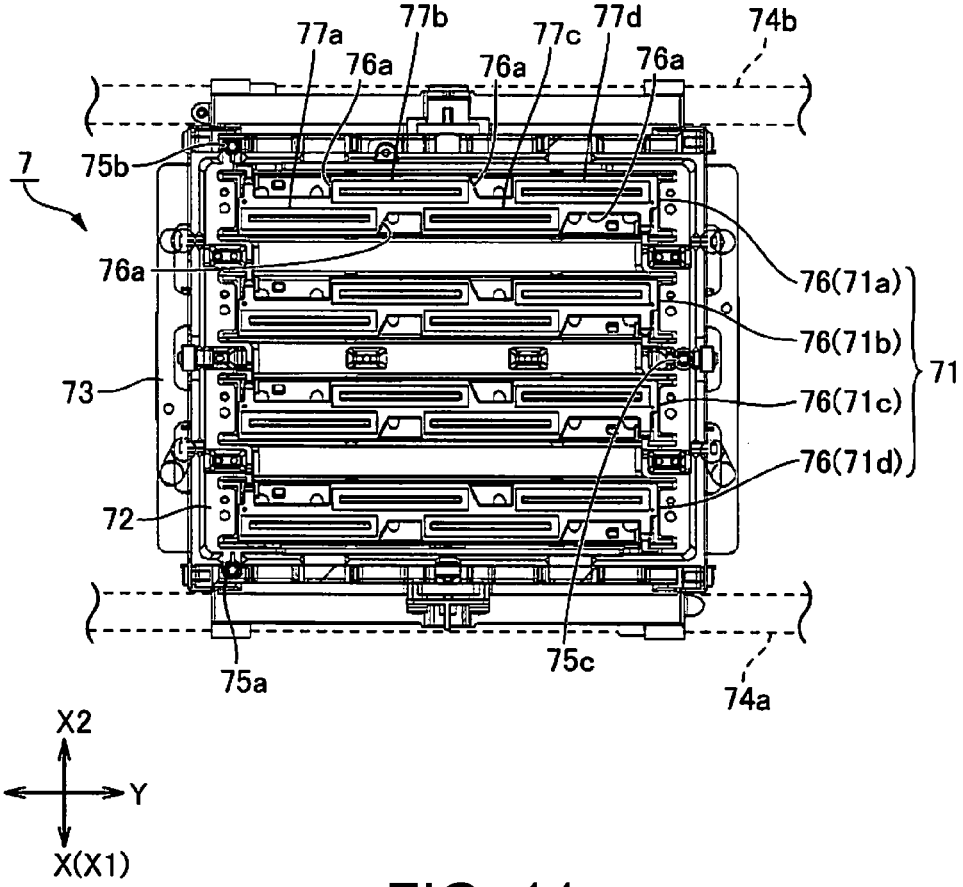
FIG. 11 is a bottom view of the head unit from the platen unit side.

FIG. 10 is an oblique view of the head unit, and FIG. 11 is a bottom view of the head unit 7 from the platen unit 8 side. As shown in FIG. 2 and FIG. 10, the head unit 7 includes the printhead 71, an inside carriage 72 that carries the printhead 71, and an outside carriage 73 that supports the inside carriage 72 movably on the vertical axis Z. Two carriage rails 74*a*, 74*b* are disposed along the transverse axis Y at the front and back sides of the head unit 7. The outside carriage 73 is mounted slidably on the two carriage rails 74*a*, 74*b*.

As shown in FIG. 2, a pressure mechanism 79A that pushes the inside carriage 72 down toward the platen surface 8*a* is disposed above the head unit 7. The pressure mechanism 79A is driven by a pressure motor not shown. Note that the pressure mechanism 79A is not shown in FIG. 10.

As shown in FIG. 10, however, four coil springs 79B that urge the inside carriage 72 up (the direction away from the platen surface 8*a*) are disposed between the outside carriage 73 and the inside carriage 72. When pressure from the pressure mechanism 79A is released, the inside carriage 72 is pushed up by the urging force of the coil springs 79B. In other words, a printhead lifting mechanism 79 that moves the printhead 71 toward and away from the platen surface 8*a* is configured by the pressure mechanism 79A and the coil springs 79B.

Figure 12A:
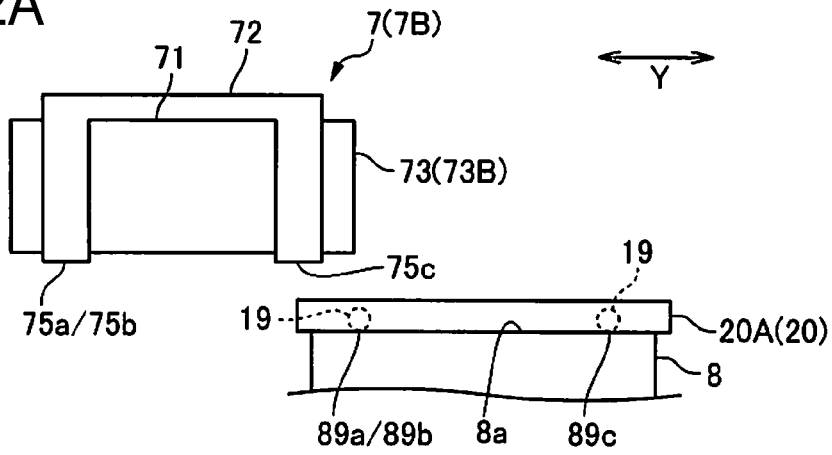
FIGS. 12A-12C illustrate operation of the head unit.
Figure 12B:
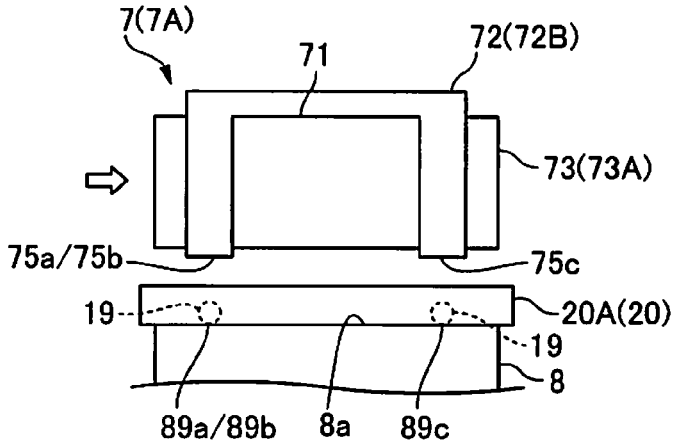
Figure 12C:
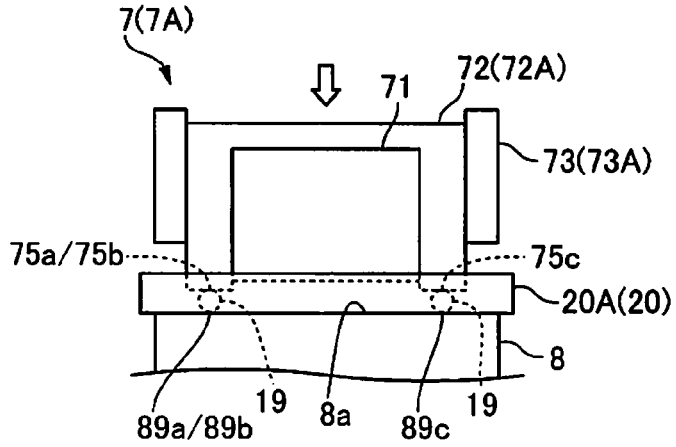

FIGS. 12A-12C illustrate operation of the head unit 7, FIG. 12A showing the head unit 7 in the retracted position 7B, and FIGS. 12B and 12C showing the head unit 7 in the print position 7A.

The head unit 7 is configured to move between the print position 7A where the printhead 71 is opposite the platen surface 8*a*, and the retracted position 7B where the printhead 71 is retracted from above the platen unit 8. Because the platen top unit 20 is disposed above the platen unit 8 in this embodiment of the disclosure, the operation of moving between the print position 7A and the retracted position 7B occurs with the inside carriage 72 and the printhead 71 raised to a position where there is no interference with the platen top unit 20 as shown in FIG. 12B. To eject ink from the printhead 71 and print, the inside carriage 72 and the printhead 71 are lowered so that the inside carriage 72 contacts the bearing balls 19 held by the platen top unit 20 as shown in FIG. 12C.

Drive power from a carriage motor not shown causes the outside carriage 73 to move along the carriage rails 74*a*, 74*b*. The outside carriage 73 moves between a first position 73A opposite the platen unit 8 (FIGS. 12B and C), and a second position 73B retracted from the platen unit 8 (FIG. 12A). By moving the inside carriage 72 carrying the printhead 71 up and down relative to the outside carriage 73 when the outside carriage 73 is in the first position 73A, the inside carriage 72 can move between a platen gap holding position 72A pressing the bearing balls 19 to the platen-side stops 89*a*, 89*b*, 89*c* (FIG. 12C), and a raised position 72B where the printhead 71 and the inside carriage 72 do not interfere with the top unit body 20A (FIG. 12B).

As shown in FIG. 11, the printhead 71 includes four heads, first head 71*a*, second head 71*b*, third head 71*c*, and fourth head 71*d*. Ink nozzles that eject one of the four ink colors CMYK are formed in each head. Head-side stops 75*a*, 75*b*, 75*c* are formed on the bottom end of the inside carriage 72 that carries the printhead 71 (first head 71*a* to fourth head 71*d*). The head-side stops 75*a*, 75*b*, 75*c* are formed at the three positions matching the bearing ball holders 23*a* to 23*c* of the top unit body 20A when the outside carriage 73 moves to the first position 73A opposite the platen unit 8, and the head unit 7 is in the print position 7A.

As shown in FIG. 12C, the head unit 7 is set to the print position 7A, and the inside carriage 72 is then lowered to the platen gap holding position 72A by the pressure mechanism 79A of the printhead lifting mechanism 79. This causes the three head-side stops 75*a*, 75*b*, 75*c* to contact the three bearing balls 19 held by the top unit body 20A from above, and press the bearing balls 19 to the platen-side stops 89*a*, 89*b*, 89*c*. As a result, the gap (the platen gap) between the nozzle face of the printhead 71 (the ink nozzle faces 77*a* to 77*d* described below) and the platen surface 8*a* is held at a specific dimension appropriate to the diameter of the bearing balls 19. As described below, the head unit 7 and the platen top unit 20 are configured so they can lower the inside carriage 72 and the printhead 71 mounted thereon to the platen gap holding position 72A without interfering with each other.

Star Wheel

In addition to the bearing balls 19, a star wheel that prevents the continuous paper P from lifting away from the platen surface 8*a* is disposed on the top unit body 20A of the platen top unit 20. As shown in FIGS. 9A and 9B, two types of star wheels are disposed on the top unit body 20A. The first star wheels 25A are disposed protruding to the front or the back from the horizontal frame members 22*a* to 22*e*. The second star wheels 25B are disposed protruding straight down from the horizontal frame members 22*a* to 22*e*.

Of the five horizontal frame members 22*a* to 22*e* disposed on the top unit body 20A, the first star wheels 25A are disposed on the three middle horizontal frame members 22*b* to 22*d* (not including the two end horizontal frame members 22*a*, 22*e*) at four locations overlapping the four horizontal belt portions 81*a*. Each group of four first star wheels 25A includes two disposed protruding to the front and two protruding to the back at alternating positions along the transverse axis Y. Two first star wheels 25A are disposed on the two end horizontal frame members 22*a*, 22*e*. More specifically, two first star wheels 25A are disposed protruding to the back from the horizontal frame member 22*a* closest to the front, and two first star wheels 25A are disposed protruding to the front from the horizontal frame member 22*e* closest to the back.

Five second star wheels 25B are disposed on each of the five horizontal frame members 22*a* to 22*e* of the top unit body 20A. More specifically, on each of the three middle horizontal frame members 22*b* to 22*d*, one second star wheel 25B is disposed beside the first star wheel 25A closest to the longitudinal frame member 21*b*. Two second star wheels 25B are disposed in each space between the remaining three first star wheels 25A. Five second star wheels 25B are also disposed on the two end horizontal frame members 22*a*, 22*e*.

Numerous first star wheels 25A and second star wheels 25B are thus disposed on the top unit body 20A in the area overlapping the platen surface 8*a*. Media is thus prevented from lifting away from any part of the platen surface 8*a* by these first star wheels 25A and second star wheels 25B.

The locations of the first star wheels 25A on the horizontal frame members 22*a* to 22*e* are set so that the first star wheels 25A do not overlap on the longitudinal axis X (the conveyance direction of the continuous paper P). More specifically, the first star wheels 25A appear at first glance to be aligned at equal intervals in four straight lines on the longitudinal axis X in FIG. 9B, but their positions are actually offset slightly from each other on the transverse axis Y.

The locations of the second star wheels 25B on the horizontal frame members 22*a* to 22*e* are also set so that the second star wheels 25B do not overlap on the longitudinal axis X (the conveyance direction of the continuous paper P). More specifically, the second star wheels 25B appear at first glance to be aligned at equal intervals in five straight lines on the longitudinal axis X in FIG. 9B, but their positions are actually offset slightly from each other on the transverse axis Y.

This configuration avoids the same position on the continuous paper P from being pressed down by multiple first star wheels 25A and second star wheels 25B when the continuous paper P is conveyed. The first star wheels 25A and second star wheels 25B are therefore prevented from leaving tracks on the continuous paper P.

Star Wheel Support Structure

Figure 13:
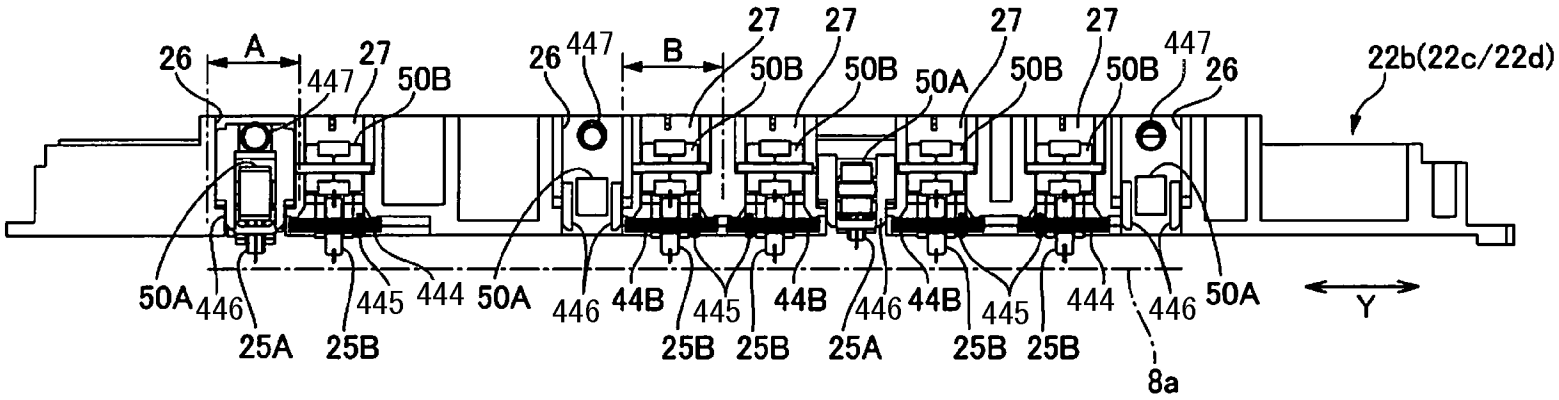
FIG. 13 is a section view through the transverse axis of the top unit body.

FIG. 13 is a section along on the transverse axis Y (through Z1-Z1 in FIG. 9A) of the top unit body 20A.

Figure 14A:
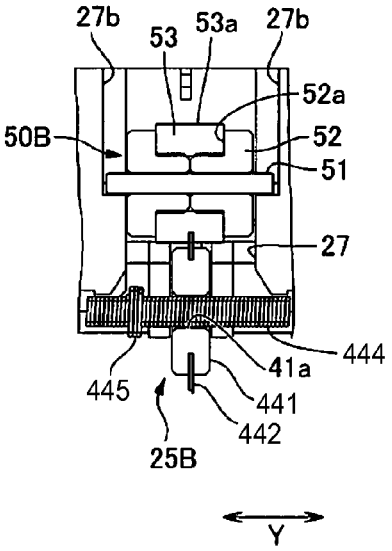
FIGS. 14A and 14B illustrate the installation structure of the second star wheel.
Figure 14B:
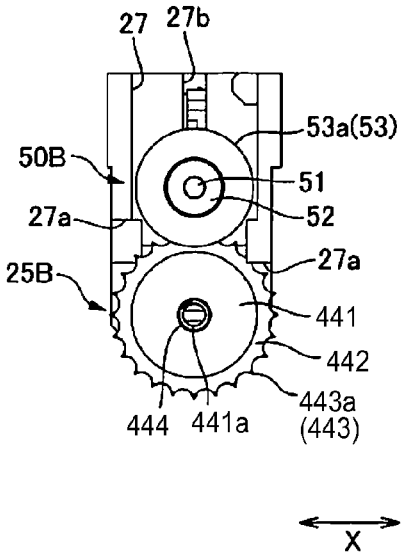

FIG. 14A illustrates the installation structure of a second star wheel 25B, FIG. 14A being a section view through the transverse axis Y (an enlarged view of area B in FIG. 13), and FIG. 14B being a section view through the longitudinal axis X (a section through Z2-Z2 in FIG. 9A).

Figure 15B:
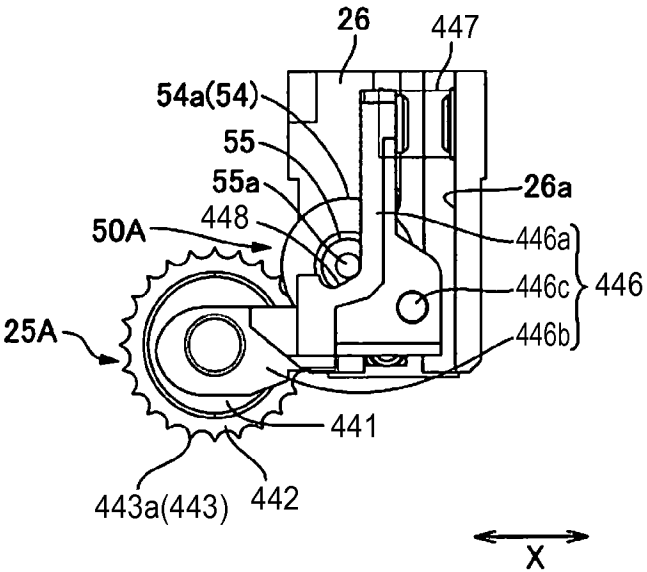
FIGS. 15A and 15B illustrate the installation structure of the first star wheel.
Figure 15A:
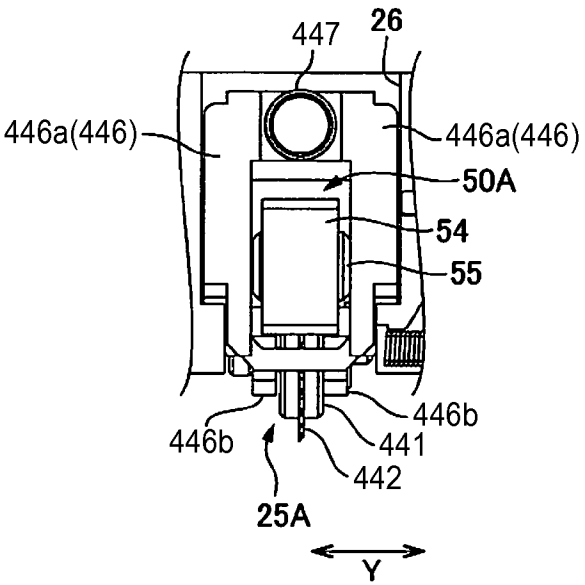

FIGS. 15A and 15B illustrate the installation structure of a first star wheel 25A, FIG. 15A being a section view through the transverse axis Y (an enlarged view of area A in FIG. 13), and FIG. 15B being a section view through the longitudinal axis X (a section through Z3-Z3 in FIG. 9A).

As shown in FIG. 9A and FIG. 13, a first installation unit 26 is formed on the horizontal frame member 22*b* at the four locations where the first star wheels 25A are disposed. The first installation unit 26 is a recess that opens to the side from which the first star wheel 25A protrudes.

A second installation unit 27 is formed on the horizontal frame member 22*b* at the five locations where the second star wheels 25B are disposed. The second installation unit 27 is a through-hole with a substantially rectangular section that passes through the horizontal frame member 22*b* along the vertical axis Z (the direction perpendicular to the platen surface 8*a*). A first installation unit 26 and a second installation unit 27 are likewise formed at the locations of the first star wheels 25A and the second star wheels 25B on the other horizontal frame members 22*a*, and 22*c* to 22*e*.

The installation structure of the second star wheel 25B to the second installation unit 27 is described next with reference to FIG. 9A, FIG. 13, and FIGS. 14A and 14B.

One end (the bottom end) of the second installation unit 27 faces and opens to the platen surface 8*a*, and a second star wheel 25B is disposed therein partially protruding from the opening to the platen surface 8*a* side. The second star wheel 25B includes a round roller 441 of a specific thickness, and a thin wheel member 442 protruding radially to the outside from the outside surface of the roller 441. As shown in FIG. 14B, teeth 443 are formed at a specific angular interval circumferentially around the outside edge of the wheel member 442. The tips 443*a* of the teeth 443 are pointed, and project in a star pattern to the outside circumferentially from the perimeter of the second star wheel 25B. As shown in FIG. 9A, a slotted channel 27*a* that extends up from the open end on the bottom (the platen surface 8*a* side) of the second installation unit 27 is formed in the horizontal frame member 22*b* at both sides on the longitudinal axis X. The second star wheel 25B is installed with the outside edge inserted to the slotted channel 27*a*.

As shown in FIG. 14A, the second star wheel 25B has a center hole 441*a* formed passing through the radial center of the roller 441 on the transverse axis Y, and a coil spring 444 extending along the transverse axis Y is fit into this center hole 441*a*. The ends of the coil spring 444 are held by the edges of the opening in the second installation unit 27 facing the platen surface 8*a*, and the second star wheel 25B is supported by the coil spring 444. The second star wheel 25B is urged to the platen surface 8*a* side by the urging force of a torsion spring 445 (urging member) attached to the coil spring. As a result, the tip 443*a* of the teeth 443 of the second star wheel 25B is elastically supported contacting the continuous paper P on the platen surface 8*a*.

A wheel cleaner 50B is disposed on the second installation unit 27 above the second star wheel 25B (on the opposite side as the platen surface 8*a*). The wheel cleaner 50B includes an axle 51 extending along the transverse axis Y, a tubular support body 52 attached coaxially to the axle 51, and a cleaning member 53 of a specific thickness disposed around the entire circumference of a channel 52*a* formed in the axial center of the outside of the support body 52. A foamed plastic or other elastic member may be used as the cleaning member 53. The axle 51, support body 52, and cleaning member 53 are assembled as a unit, and the wheel cleaner 50B is configured as a roller that rotates in unison on the axle 51.

A pair of inside walls opposing each other along the transverse axis Y are disposed in the top of the second installation unit 27. A pair of channels 27*b* that support the ends of the axle 51 movably up and down and freely rotatably are formed in these inside walls. The ends of the axle 51 are inserted to the channels 27*b*, and the wheel cleaner 50B is disposed resting on top of the second star wheel 25B. The wheel cleaner 50B is therefore disposed with the outside surface 53*a* of the cleaning member 53 pressed by its own weight against the tips 443*a* of the teeth 443 of the second star wheel 25B.

When the second star wheel 25B turns following the continuous paper P conveyed over the platen surface 8*a*, the wheel cleaner 50B pressed against the tips 443*a* of the teeth 443 rotates following the second star wheel 25B. As a result, after contacting the continuous paper P, the tips 443*a* of the teeth 443 sequentially contact the outside surface 53*a* of the cleaning member 53, and ink and other foreign matter sticking to the tips 443*a* of the teeth 443 is removed.

The second star wheel 25B is supported movably up and down following dips and rises in the continuous paper P due to the urging force of the torsion spring 445, but the wheel cleaner 50B moves of its own weight and continues following the movement of the second star wheel 25B even when the second star wheel 25B moves due to the urging force of the torsion spring 445. Therefore, the cleaning member 53 is held pressed against the tips 443*a* of the teeth 443, and can clean continuously.

The installation structure of the first star wheel 25A to the first installation unit 26 is described next referring to FIG. 9A, FIG. 13, and FIGS. 15A and 15B.

As shown in FIG. 9A, the first installation unit 26 is a recessed channel that recedes to the front or the back side. A star wheel support member 46 is attached to the first installation unit 26 as shown in FIGS. 15A and B. The star wheel support member 446 includes a first arm 446*a* extending along the recessed bottom 26*a* of the first installation unit 26; a curved member comprising a second arm 446*b* that protrudes to the opposite side as the recessed bottom 26*a* from the bottom end of the first arm 446*a* (the end on the platen surface 8*a* side); and a support pin 446*c* connecting two curved members with a specific gap therebetween on the transverse axis Y. A pair of inside walls in mutual opposition on the transverse axis Y are disposed on the end of the first installation unit 26 on the platen surface 8*a* side, and the support pin 446*c* extends rotatably therebetween on the transverse axis Y.

The star wheel support member 446 is disposed with the two second arms 446*b* protruding from the first installation unit 26. The first star wheel 25A is installed rotatably on an axle not shown between the two second arms 446*b*.

The first star wheel 25A is configured identically to the second star wheel 25B, including the roller 441 and wheel member 442 described above with teeth 443 projecting in a radiating pattern to the outside radially from the outside surface. A coil spring 447 (urging member) is disposed between the top end of the first arm 446*a* and the recessed bottom 26*a*. The star wheel support member 446 can pivot on the support pin 446*c* due to the urging force of the coil spring 447, and the first star wheel 25A attached to the distal end of the second arm 446*b* is urged to the platen surface 8*a* side. As a result, the tips 443*a* of the teeth 443 of the first star wheel 25A are elastically supported in contact with the continuous paper P on the platen surface 8*a*.

A wheel cleaner 50A is disposed on the first installation unit 26 diagonally above the first star wheel 25A. The wheel cleaner 50A includes a tubular cleaning member 54 made from the same material as the cleaning member 53 of the wheel cleaner 50B described above, and a support body 55 fit into the center hole formed in the radial center of the cleaning member 54. An axle 55*a* that protrudes to both sides on the transverse axis Y is disposed in the support body 55. Recesses 448 (see FIG. 15B) that support the axle 55*a* are formed in the star wheel support member 46 at the corners where the first arm 446*a* and second arm 446*b* connect. The bottom of the recess 448 is formed in a slope that descends toward the platen surface 8*a* with proximity to the first star wheel 25A. By setting the axle 55*a* on the bottom of the recess 448, the outside surface 54*a* of the cleaning member 54 is pressed by the weight of the wheel cleaner 50A from diagonally above the first star wheel 25A against the tips 443*a* of the teeth 443 of the first star wheel 25A.

When the first star wheel 25A turns following the continuous paper P conveyed over the platen surface 8*a*, the wheel cleaner 50A pressed against the tips 443*a* of the teeth 443 also turns. As a result, after contacting the continuous paper P, the tips 443*a* of the teeth 443 sequentially contact the outside surface 54*a* of the cleaning member 54, and ink and other foreign matter sticking to the tips 443*a* of the teeth 443 is removed.

The first star wheel 25A is supported movably up and down following dips and rises in the continuous paper P due to the urging force of the coil spring 447, but the wheel cleaner 50A moves of its own weight along the bottom of the recess 448 and continues following the movement of the first star wheel 25A even when the first star wheel 25A moves due to the urging force of the coil spring 447. The cleaning member 54 is therefore held pressed by its own weight against the tips 443*a* of the teeth 443.

Shape of the Distal End of the Printhead

As shown in FIG. 11, the distal ends 76 of the four printheads (first head 71*a* to fourth head 71*d*) are arranged at a regular interval along the longitudinal axis X in a rectangular area surrounded by the inside carriage 72 on the surface of the head unit 7 facing the platen surface 8*a*. The four distal ends 76 have the same shape, which is narrow and long along the transverse axis Y.

A set of four ink nozzle faces 77*a* to 77*d* forming ink nozzle rows are formed in each distal end 76. The four ink nozzle faces 77*a* to 77*d* have a long narrow shape parallel to the transverse axis Y. More specifically, in each distal end 76, ink nozzle faces 77*a* and 77*c* are arranged in one row with a specific gap therebetween along the transverse axis Y, and adjacent thereto along the longitudinal axis X, ink nozzle faces 77*b* and 77*d* are arranged in one row with a specific gap therebetween on the longitudinal axis X.

When seen along the longitudinal axis X, the ink nozzle faces 77*a* to 77*d* are disposed offset a specific distance along the transverse axis Y, and the ink nozzles are disposed on the distal end 76 covering the full range of an area including the maximum width of the printable continuous paper P. A recess 76*a* is formed at two locations in the gaps where the ink nozzle faces 77*a* and 77*c* are not formed on the front side of the distal end 76. A recess 76*a* is also formed at two locations in the gaps where the ink nozzle faces 77*b* and 77*d* are not formed on the back side of the distal end 76.

When the head unit 7 is set to the print position 7A opposite the platen unit 8, the four distal ends 76 of the printhead 71 (first head 71*a* to fourth head 71*d*) are set to the positions matching the spaces enclosed between the horizontal frame members 22*a* to 22*e* as indicated by the dot-dash lines shown in FIG. 9B. The distal ends 76 are also positioned so that the recesses 76*a* formed in the distal ends 76 fit into the positions where the first star wheels 25A are disposed in the spaces between the horizontal frame members 22*a* to 22*e*.

More specifically, the four distal ends 76 are positioned relative to the spaces between the horizontal frame members 22*a* to 22*e* and the first star wheels 25A so that the distal ends 76 are set to a position vertically opposite the platen surface 8*a* (in other words, the direction perpendicular to the conveyance direction of the continuous paper P and the width of the continuous paper P), and facing the continuous paper P on the platen surface 8*a*.

At the print position 7A, the head unit 7 lowers the inside carriage 72 and the printhead 71 to the platen gap holding position 72A. At this time, the four distal ends 76 enter the spaces between the horizontal frame members 22*a* to 22*e* and the first star wheels 25A with no interference. Because the second star wheels 25B are disposed directly below the horizontal frame members 22*a* to 22*e*, there is also no interference between the second star wheels 25B and the distal ends 76. The printhead 71 and the inside carriage 72 can therefore be lowered and the platen gap can be held to a specific dimension without interfering with the platen top unit 20 and the head unit 7. Four colors of ink can also be ejected from the four distal ends 76 covering the full range of the maximum width of printable continuous paper P, and can print to the full width of the continuous paper P. When moving the head unit 7 to the retracted position 7B, the head unit 7 can also be raised without interfering with the platen top unit 20.

Figure 18A:
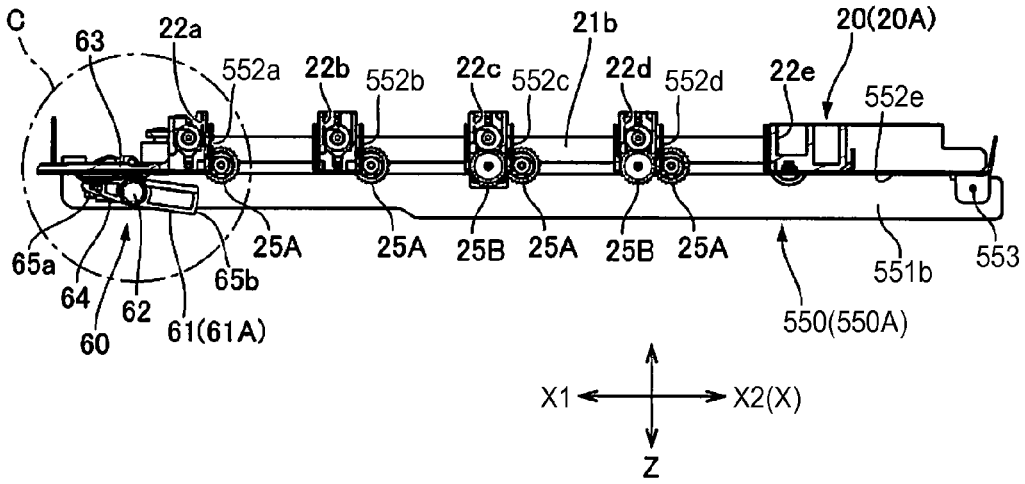
FIGS. 18A and 18B are section views of the platen top unit body and the cover member.
Figure 18B:
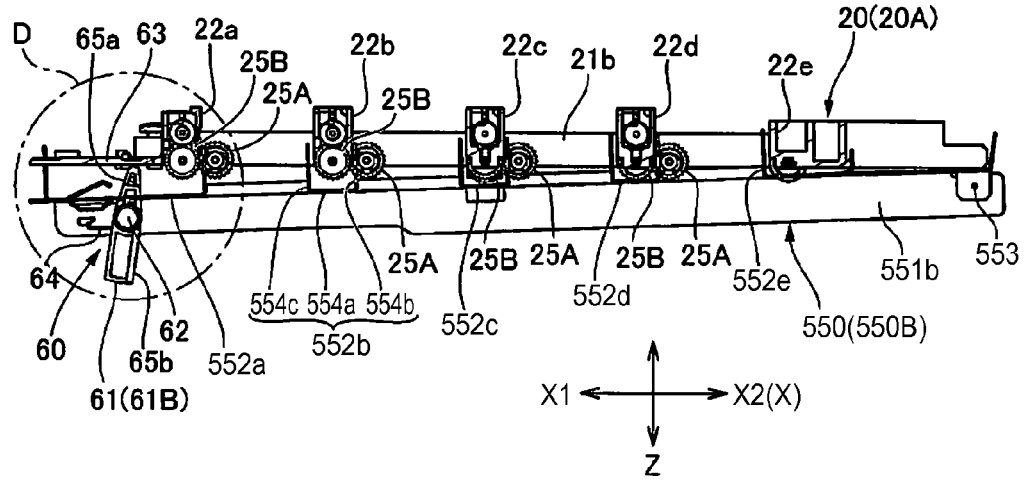

FIGS. 18A and 18B are section views of the top unit body 20A and a cover member 550, FIG. 18A being a section view through A-A in FIG. 17A, and FIG. 14B being a section view through B-B.

The cover member 550 is disposed below the platen top unit 20 superimposed with the platen top unit 20 along the vertical axis Z. The cover member 550 has a pair of longitudinal frame members 551*a*, 551*b* extending parallel to each other and superimposed along the vertical axis Z with the longitudinal frame members 21*a*, 21*b* of the platen top unit 20; and five cover frame members 552*a* to 552*e* extending parallel to the transverse axis Y between the longitudinal frames members 551*a*, 551*b*. The back end of the cover member 550 is pivotably attached to the back end of the top unit body 20A. The cover member 550 can therefore pivot vertically on the axis of rotation 553 extending on the longitudinal axis X at the back end. Note that a configuration in which the cover member 550 is directly attached to the main frame of the printer 1 is also possible.

When the platen unit 8 is in the opposing position 8A, the cover member 550 is disposed horizontally below the platen top unit 20. This is the retracted position 550A of the cover member 550.

When the platen unit 8 is in the open position 8B, the cover member 550 pivots down of its own weight to a position where the front end is pointing down at an angle. This is the cover position 550B of the cover member 550.

A stop not shown that prevents the cover member 550 from pivoting below the cover position 550B is disposed below the cover member 550.

When the platen unit 8 moves from the open position 8B to the opposing position 8A, the cover member 550 is pushed up by the platen unit 8 and moves to the retracted position 550A. More specifically, a protrusion not shown that projects down is disposed on the outside frame part on the front of the cover member 550 (the part formed by the longitudinal frames members 551*a*, 551*b* or the cover frame member 552*a*). A stop not shown is also disposed on the platen unit 8 at a position superimposed with this protrusion. When the platen unit 8 moves from the open position 8B to the opposing position 8A, the protrusion and the stop meet, the cover member 550 is pushed up, and the cover member 550 moves to the retracted position 550A. When in the opposing position 8A, the platen unit 8 supports the cover member 550 through the stops so that the cover member 550 will not descend.

As shown in FIGS. 18A and 18B, the cover frame members 552*a* to 552*e* are arranged so that they are superimposed with the horizontal frame members 22*a* to 22*e* (support frame) of the platen top unit 20, respectively, along the vertical axis Z. Each of the cover frame members 552*a* to 552*e* has a bottom 554*a* and side members 554*b*, 554*c* that rise up from the opposite sides along the transverse axis Y, forming a U-shaped section that opens to the top (see FIG. 19). At the retracted position 550A, the cover frame members 552*a* to 552*e* are raised to a position where the bottoms 554*a* contact the horizontal frame members 22*a* to 22*e* from below, and the horizontal frame members 22*a* to 22*e* are housed from below in the cavity of the upward-facing channel enclosed by the bottom 554*a* and the side members 554*b*, 554*c*. In this position, the outside circumference parts of the first and second star wheels 25A, 25B are exposed below the cover frame members 552*a* to 552*e*. More specifically, in the retracted position 550A, the cover frame members 552*a* to 552*e* are held in a position separated further from the platen surface 8*a* than the first and second star wheels 25A, 25B. The cover frame members 552*a* to 552*e* therefore do not interfere with passage of the continuous paper P or the function of the first and second star wheels 25A, 25B preventing the continuous paper P from lifting away from the platen surface 8*a*.

Figure 19:
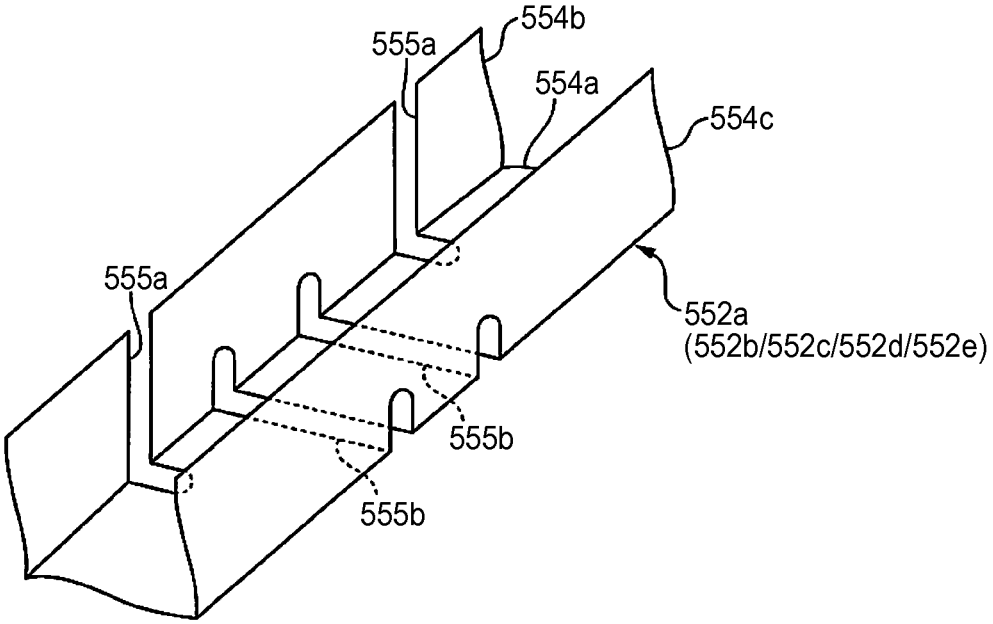
FIG. 19 is an oblique view of the cover frame.

FIG. 19 schematically illustrates the cover frames. As shown in this figure, a notch 555*a* and an opening 555*b* are respectively formed in each of the cover frame members 552*a* to 552*e* at the position of the bottom 554*a* vertically aligned with the second star wheels 25B, and the positions of the side members 554*b*, 554*c* that interfere with the first star wheels 25A. The first star wheels 25A are exposed to the outside of the cover frame members 552*a* to 552*e* from the notches 555*a*, and the second star wheels 25B are exposed from the openings 555*b*. As a result, the cover member 550 can be moved to the retracted position 550A without the cover frame members 552*a* to 552*e* interfering with the first and second star wheels 25A, 25B. The structure for retracting the cover frame members 552*a* to 552*e* while covering the horizontal frame members 22*a* to 22*e* does not require providing space for retracting the cover frame members 552*a* to 552*e* outside of the platen top unit 20. Space can therefore be saved.

At the cover position 550B, the bottoms 554*a* of the cover frame members 552*a* to 552*e* protrude below the first and second star wheels 25A, 25B. The first and second star wheels 25A, 25B are therefore prevented from being exposed in the large open space above the platen unit 8 in the open position 8B.

A locking mechanism 60 that locks the cover member 550 so that it cannot move from the cover position 550B to the retracted position 550A is disposed on the cover member 550 and the platen top unit 20. The locking mechanism 60 includes a lock lever 61 (lock member) attached to each of the longitudinal frames members 551*a*, 551*b* at the front X1 end; a torsion spring 64 (urging member) that urges the lock lever 61; and a lock lever stop 63 (lock member stop) disposed on the longitudinal frame members 21*a*, 21*b* of the platen top unit 20 at a position superimposed with the lock lever 61 along the vertical axis Z.

Figure 20A:
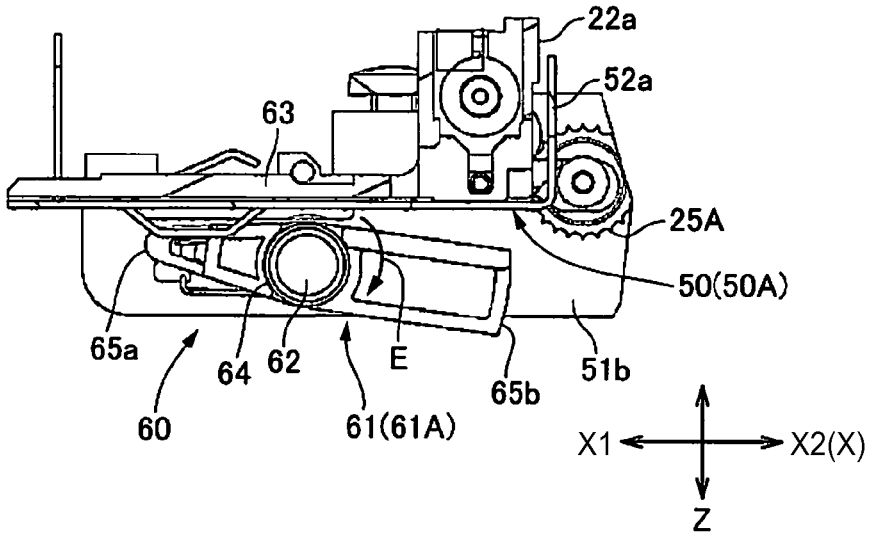
FIGS. 20A and 20B are enlarged views of part of the locking mechanism.
Figure 20B:
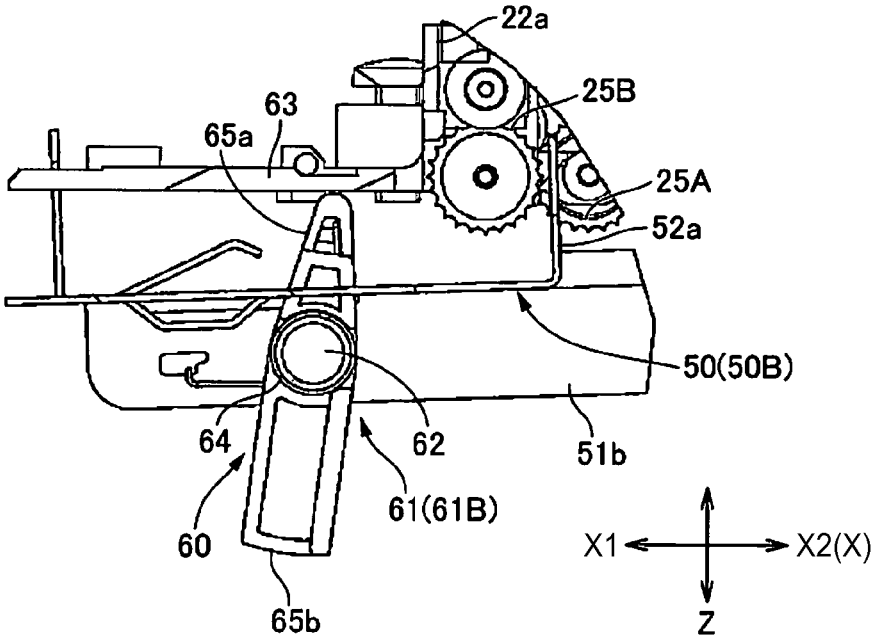

FIGS. 20A and 20B are enlarged views of part of the locking mechanism 60, FIG. 20A showing an enlarged view of area C in FIG. 18A, and FIG. 20B showing an enlarged view of area D in FIG. 18B. FIG. 18A and FIG. 20A show the locking mechanism when the lock is not engaged, and FIG. 18B and FIG. 20B show the locking mechanism when locked.

The lock lever 61 is a straight member, and can rock on an axle 62 disposed substantially in the lengthwise center. One end 65*a* of the lock lever 61 gradually becomes narrower towards the distal end. The torsion spring 64 is mounted on the axle 62, one end of the spring is engaged by the longitudinal frame member 551*a* (551*b*), and the other end is engaged by the one end 65*a* of the lock lever 61. The lock lever 61 is urged by the torsion spring 64 in the direction causing the one end 65*a* to pivot up (direction E in FIG. 20A).

When the cover member 550 is in the retracted position 550A, the lock lever 61 is pushed from above by the lock lever stop 63, and the one end 65*a* pivots to an angular position facing the front. This is the release position 61A of the lock lever 61.

When the cover member 550 is in the cover position 550B, the lock lever 61 can pivot up into the space formed between the lock lever 61 and the longitudinal frame member 21*a* (21*b*), and the one end 65*a* pivots to an angular position facing the opposite side as the platen unit 8. This is the locked position 61B of the lock lever 61. In the locked position 61B, the one end 65*a* of the lock lever 61 projects up from the longitudinal frame member 21*a* (21*b*), that is, away from the platen unit 8, and contacts the lock lever stop 63 from below. As a result, even if the cover member 550 is pushed up, the one end 65*a* of the lock lever 61 contacts the lock lever stop 63 and cannot rise. More specifically, the cover member 550 is locked and cannot move from the cover position 550B to the retracted position 550A.

As shown in FIG. 16B and FIG. 17B, a cam member 84 is disposed on each side of the platen unit 8 on the transverse axis Y, and has a cam surface 884*a* at the top. When the platen unit 8 rises toward the opposing position 8A, the other end 65*b* of the lock lever 61 is pushed to the back side by the cam surface 884*a*, and the lock lever 61 pivots in the opposite direction as the urging direction of the torsion spring 64. When the platen unit 8 is set to the opposing position 8A, the lock lever 61 pivots to the release position 61A. In the release position 61A, the lock lever 61 is positioned horizontally not protruding above the longitudinal frame member 21*a* (21*b*) (that is, to the opposite side as the platen unit 8), and movement of the cover member 550 to the retracted position 550A is not obstructed.

The locking mechanism 60 is disposed along the longitudinal frames members 551*a*, 551*b* of the cover member 550, and the longitudinal frame members 21*a*, 21*b* of the platen top unit 20, at a position outside the platen surface 8*a* along the transverse axis Y, that is, outside the direction perpendicular to the media conveyance direction, more specifically the locking mechanism 60 is not exposed in the space created by opening the platen unit 8.

As described above, the printer 1 according to this embodiment of the disclosure has a head unit 7 that can move between a print position 7A where the printhead 71 is opposite the platen surface 8*a*, and retracted position 7B where the printhead 71 is in retracted from the print position 7A; and a platen top unit 20 disposed superimposed with the platen surface 8*a* and separated from the platen unit 8. First star wheels 25A and second star wheels 25B carried by the platen top unit 20 prevent the continuous paper P from separating from the platen surface 8*a*.

By thus separating the first star wheels 25A and second star wheels 25B from the head unit 7, the reduction in the positioning precision of the first star wheels 25A and second star wheels 25B to the platen surface 8*a* as a result of moving the head unit 7 between the print position 7A and the retracted position 7B can be avoided. Because increasing the size of the head unit 7 as a result of integrating the platen top unit 20 carrying the first star wheels 25A and second star wheels 25B can be avoided, complicating the support structure of the head unit 7 can also be avoided, and increased cost incurred by increasing the output of the carriage motor that drives the head unit 7 can be avoided.

Wheel cleaners 50A, 50B that contact the tips 443*a* of the teeth 443 on the first star wheels 25A and second star wheels 25B are also disposed on the platen top unit 20 in the embodiment described above. By thus removing soiling of the first star wheels 25A and second star wheels 25B by ink from the continuous paper P immediately after printing, soiling of the continuous paper P by ink on the first star wheels 25A and second star wheels 25B can also be avoided.

Furthermore, the wheel cleaners 50A, 50B are rollers with a tubular outside surface 53*a*, 54*a* in this embodiment, and are disposed with the outside surfaces 53*a*, 54*a* contacting the tips 443*a* of the teeth 443. As a result, because the wheel cleaners 50A, 50B turn in conjunction with rotation of the first star wheels 25A and second star wheels 25B, interference with rotation of the first star wheels 25A and second star wheels 25B by the cleaning operation can be suppressed. The entire outside surface of the outside surfaces 53*a*, 54*a* of the wheel cleaners 50A, 50B can also be used as cleaning surfaces.

The first star wheels 25A and second star wheels 25B are urged toward the platen surface 8*a* in this embodiment, but the wheel cleaners 50A, 50B are supported to move and following movement of the first star wheels 25A and second star wheels 25B by their own weight. The tips 443*a* of the teeth 443 and the cleaning surfaces can therefore be held in constant contact.

In addition, the platen top unit 20 that carries the bearing balls 19, first star wheels 25A and second star wheels 25B is also separate from the platen unit 8. As a result, the access cover 5 at the front of the printer can be opened and the platen unit 8 can be easily pulled forward and out to remove paper jams and for maintenance. Removing continuous paper P stuck at the platen surface 8*a* is therefore simple.

The printer 1 according to this embodiment of the disclosure also has a cover member 550 that moves between a cover position 550B covering the first star wheels 25A and second star wheels 25B, and a retracted position 550A separated more from the platen surface 8*a* than at the cover position 550B, in conjunction with the opening and closing operation of the platen unit 8. Therefore, the first and second star wheels 25A, 25B can be prevented from being exposed when the platen unit 8 is moved to the open position 8B and the third conveyance path section 10*c* of the conveyance path 10 is opened when a paper jam occurs, for example. Furthermore, because a complicated construction is not required for the platen top unit 20 and cover member 550, construction can be simplified and installation is simple. In addition, because the cover member 550 is not a factor in the positioning precision of the first and second star wheels 25A, 25B or change in pressure, the cover member 550 has little effect on the media conveyance load and does not contribute to a drop in conveyance precision.

In this disclosure, the cover member 550 descends to the cover position 550B by its own weight, and when returned to the retracted position 550A, the cover member 550 is pushed up to the retracted position 550A by the platen unit 8 moving from the open position 8B to opposing position 8A. A separate mechanism for moving the cover member 550 is therefore not required, the construction is simplified, and less space is required. The cover member 550 is also supported pivotably up and down on one end, and the support structure is therefore also simple.

When the platen unit 8 opens in this embodiment, the cover member 550 is locked in the cover position 550B by the locking mechanism 60. The cover member 550 is therefore prevented from being pushed and moved by hand. Furthermore, because the locking mechanism 60 is located where it is not exposed in the opened space, accidentally releasing the lock while working can be avoided.

Other Embodiments

The first star wheels 25A and second star wheels 25B are disposed at positions that are offset from each other on the longitudinal axis X in the foregoing embodiment, but a configuration in which only some of the first star wheels 25A and second star wheels 25B are offset on the longitudinal axis X is also can be used. For example, the positions of the first star wheels 25A and second star wheels 25B could be offset from each other on the five horizontal frame members 22*a* to 22*e* that are adjacent to another.

The foregoing embodiment has two types of star wheels, first star wheels 25A and second star wheels 25B, but only one type may be used. The installation structure of the star wheel configuration is also not limited to the configuration described above, and star wheels of other configurations may be installed to the top unit body 20A.

The foregoing embodiment describes a printer 1 that holds the platen gap by contact with bearing balls 19, but the invention also can be applied to printers that hold the platen gap by other methods.

Although the present disclosure has been described in connection with the preferred embodiments thereof with reference to the accompanying drawings, it is to be noted that various changes and modifications will be apparent to those skilled in the art. Such changes and modifications are to be understood as included within the scope of the present disclosure as defined by the appended claims, unless they depart therefrom.

What is claimed is:

1. A printer comprising:

a platen unit having a platen surface that supports sheet media;

a head unit that carries a printhead that prints on the sheet media, and moves between a print position where the printhead is opposite the platen surface, and a retracted position where the printhead is retracted from the print position;

a platen top unit superimposed with the platen surface and separated from the platen unit;

star wheels disposed on the platen top unit;

wherein the platen top unit has a plurality of support frame members supporting the star wheels; and when the head unit is at the print position, an ink nozzle face of the printhead is positioned facing the platen surface through a space enclosed by the plural support frame members and the star wheels.

2. The printer described in claim 1, wherein:

the head unit has a printhead lift mechanism that moves the printhead toward and away from the platen surface;

the printhead has a distal end part where the ink nozzle face is formed; and when the printhead lift mechanism lowers the printhead to a platen gap holding position holding a specific gap between the printhead and the platen surface, the distal end part of the printhead enters the space.

3. The printer described in claim 1, wherein:

the star wheels are disposed on the plurality support frame members at different positions in the media conveyance direction.

4. The printer described in claim 1, wherein:

teeth are formed on the outside edge of the star wheel; and a wheel cleaner that contacts tips of the teeth of the star wheel when the tips of the teeth are separated from the medium is disposed on the platen top unit.

5. The printer described in claim 4, wherein:

the wheel cleaner is a roller having a tubular outside surface; and the roller is disposed so that the tubular outside surface contacts the tips of the teeth, and is supported to rotate following rotation of the star wheel.

6. The printer described in claim 5, wherein:

an urging member that urges the star wheel to the platen surface is disposed on the platen top unit; and the roller is supported to move following movement of the star wheel when the star wheel moves in the urging direction of the urging member.

7. The printer described in claim 1, wherein:

the platen top unit is fastened to the main printer frame.

8. The printer described in claim 1, wherein:

the platen unit moves between an opposing position forming a specific gap between the platen surface and the printhead, and an open position where the platen surface is further from the printhead than at the opposing position.

9. The printer described in claim 8, further comprising:

a cover member that is set to a cover position protruding further to the platen surface side than the star wheel when the platen unit is in the open position, and is set to a retracted position separated further from the platen surface than the star wheel when the platen unit is in the opposing position.

10. The printer described in claim 9, wherein:

the cover member descends of its own weight to the cover position when the platen unit moves from the opposing position to the open position; and the cover member is pushed up by the platen unit from the cover position to the retracted position when the platen unit moves from the open position to the opposing position.

11. The printer described in claim 9, wherein:

the cover member is supported pivotably such that one end of the cover member can move up and down.

12. The printer described in claim 9, wherein:

the cover member further comprises a cover frame; and when the cover member moves to the retracted position, the support frame enters a channel portion of the cover frame.

13. The printer described in claim 9, further comprising:

a locking mechanism that locks the cover immovably to the retracted position side when the cover member moves to the cover position.

14. The printer described in claim 13, wherein:

the locking mechanism includes a lock member that is attached pivotably to the cover member and can pivot to a lock position where one end points in a direction projecting from the cover member to a side opposite to the platen unit, and a release position where the one end points in a direction not projecting from the cover member to the opposite side, an urging member that urges the lock member to the lock position, and a lock member stop disposed on the platen unit at a position opposite the one end of the lock member in the lock position.

15. The printer described in claim 13, wherein:

the locking mechanism is disposed outside the platen surface in a direction perpendicular to the media conveyance direction.

* * * * *